United States Patent [19]

Goodman

[11] 4,250,797

[45] Feb. 17, 1981

[54] APPARATUS FOR MAKING CORRUGATED PACKAGES

[75] Inventor: James A. Goodman, Glencoe, Ill.

[73] Assignee: Consolidated Foods Corp., Deerfield, Ill.

[21] Appl. No.: 974,065

[22] Filed: Dec. 28, 1978

[51] Int. Cl.[3] ..... B31C 1/06; B31B 7/00

[52] U.S. Cl. ..... 93/58; 493/109; 493/112; 493/462; 493/463

[58] Field of Search ..... 93/39.1 R, 39.2, 39.3, 93/40, 40.1, 43, 55.1 R, 39 C, 39 R, 54.1, 54 R; 156/189–191, 205, 206, 462; 242/75.5, 75.51, 42, 43, 45

[56] References Cited

U.S. PATENT DOCUMENTS

| | | | |
|---|---|---|---|
| Re. 29,272 | 6/1977 | Hintz et al. | 156/208 |
| 580,086 | 4/1897 | Hilgartner | 93/40.1 |
| 1,080,039 | 12/1913 | Altmann | 93/40.1 |
| 1,090,593 | 3/1914 | Bolger | 93/94 R |
| 2,018,240 | 10/1935 | Swift, Jr. | 154/31 |
| 2,051,308 | 8/1936 | McCarthy | 93/39.1 R |
| 2,075,679 | 3/1937 | Weber | 93/45 |
| 2,326,014 | 8/1943 | Damrow | 206/45.32 |
| 2,346,135 | 4/1944 | Kress | 93/94 R |
| 2,544,722 | 5/1951 | Waters | 154/83 |
| 2,755,983 | 7/1956 | Ringler | 229/21 |
| 2,820,584 | 1/1958 | Hendry | 229/5.5 |
| 2,855,884 | 10/1958 | Magill | 113/120 |
| 2,934,466 | 4/1960 | Molla | 154/83 |
| 3,026,231 | 3/1962 | Chavannes | 156/205 |
| 3,035,498 | 5/1962 | Molla | 93/77 R |
| 3,225,727 | 12/1965 | Winton | 113/120 |
| 3,289,959 | 12/1966 | Scher | 242/45 |
| 3,300,118 | 1/1967 | Owens | 229/51 |
| 3,306,805 | 2/1967 | Klein et al. | 156/470 |
| 3,486,294 | 12/1969 | Vilen | 242/75.5 X |
| 3,503,310 | 3/1970 | Goetz | 93/94 R |
| 3,583,624 | 6/1971 | Peacock | 229/5.5 |
| 3,811,987 | 5/1974 | Wilkinson et al. | 156/497 |
| 3,837,973 | 9/1974 | Asakura et al. | 156/470 |
| 3,848,795 | 11/1974 | Bird et al. | 229/23 R |
| 3,854,861 | 12/1974 | Worrall | 425/504 |
| 3,863,552 | 2/1975 | Gabarró | 93/94 R |
| 3,923,233 | 12/1975 | Smith | 229/5.5 |
| 3,930,607 | 1/1976 | Smith | 229/5.5 |
| 3,947,206 | 3/1976 | De Ligt et al. | 425/388 |
| 3,969,173 | 7/1976 | Amberg et al. | 156/218 |
| 3,972,763 | 8/1976 | Wolvin et al. | 156/210 |
| 4,008,649 | 2/1977 | Shikaya | 93/39.2 X |
| 4,038,122 | 7/1977 | De Ligt | 156/210 |
| 4,080,880 | 3/1978 | Shikaya | 93/94 R |
| 4,086,116 | 4/1978 | Yazaki et al. | 156/205 |

FOREIGN PATENT DOCUMENTS 2014398 5/1971 Fed. Rep. of Germany .

*Primary Examiner*—James F. Coan

*Attorney, Agent, or Firm*—Hume, Clement, Brinks, Willian & Olds Ltd.

[57] ABSTRACT

A machine for forming a corrugated package from sheet material including a rotatable corrugation head having a fluted periphery and a front face; corrugating means and sealing means movable into association with the head for corrugating an inner sheet material and sealing two plys of material together, respectively; means for feeding an inner sheet having a selected length and width to the head adjacent said corrugating means and means for feeding an outer sheet having a selected length and width to the head adjacent the sealing means; means for moving a bottom wall member having a selected shape into engagement with the front face of the head and associated with the first and second sheets to form the bottom wall of the package; and means to control the operation of said machine so that the rotation of said head and the function of the above-described components are coordinated to form a corrugated side wall of the package from two sheets simultaneously with the joinder of said side wall with the bottom wall member.

The method of forming a corrugated package pursuant to this invention comprises the steps of corrugating an inner sheet of material having a selected width and length into fluted corrugations while forming the sheet into a shape defining a portion of the package side wall; positioning a bottom wall member having an outer edge adjacent the corrugated inner sheet; wrapping an outer sheet of material having a width greater than the width of the inner sheet around the corrugated inner sheet so that a portion of the outer sheet projects over the outer edge of the bottom wall member and; simultaneously joining the outer sheet to the inner sheet and to said bottom wall member so that said sheets form plys of a corrugated side wall and are joined to said bottom wall member to produce a corrugated package.

15 Claims, 27 Drawing Figures

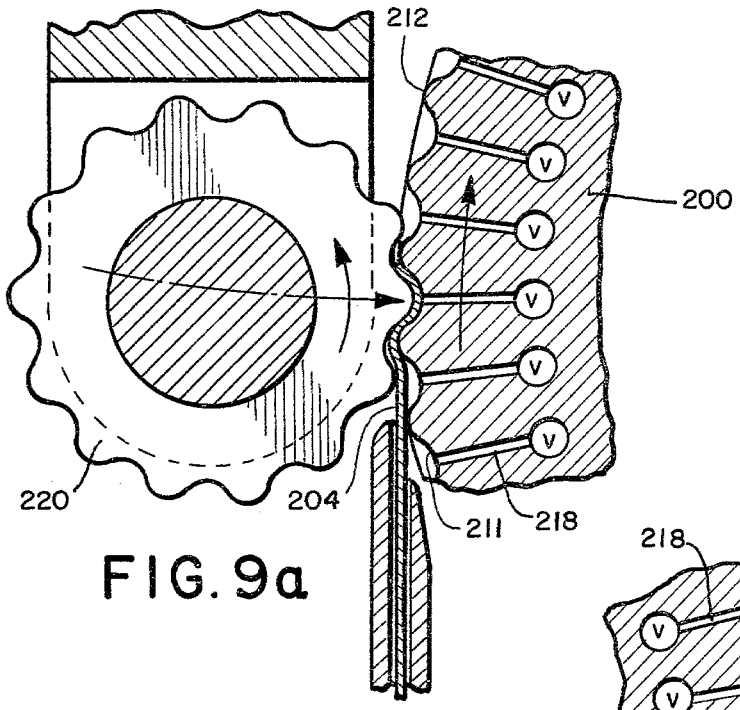
FIG. 9a
FIG. 11a
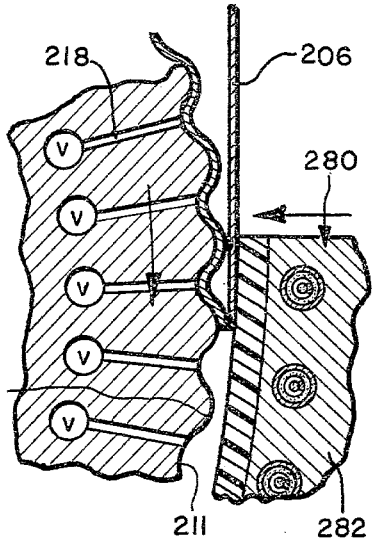
FIG. 9b
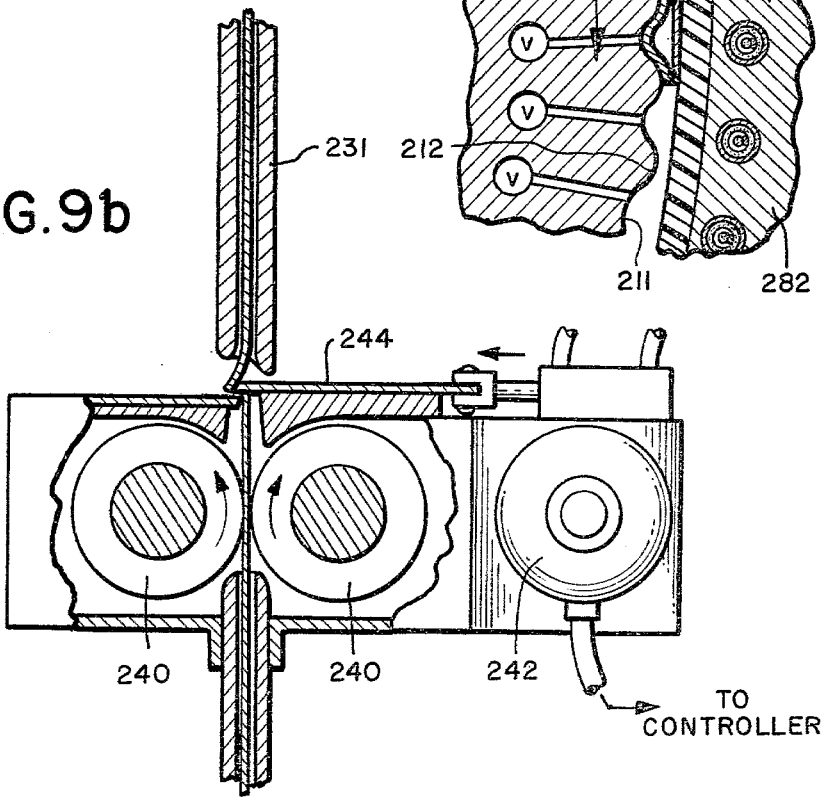

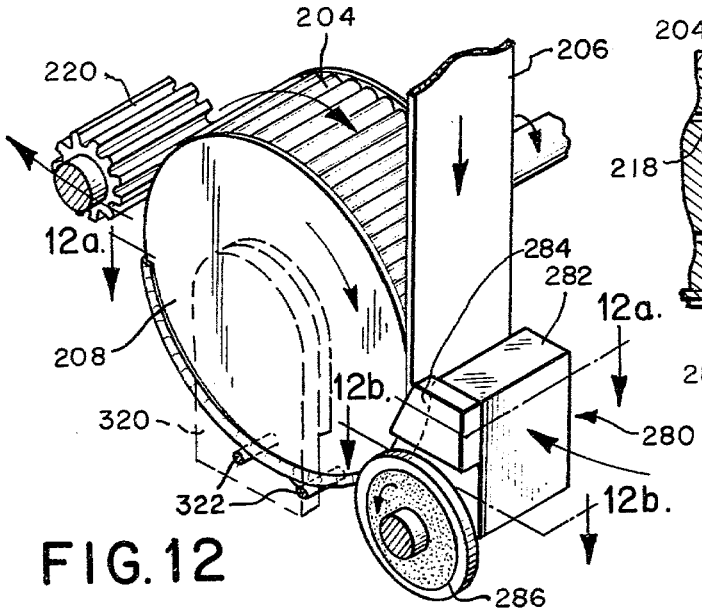
FIG. 12
FIG. 12b
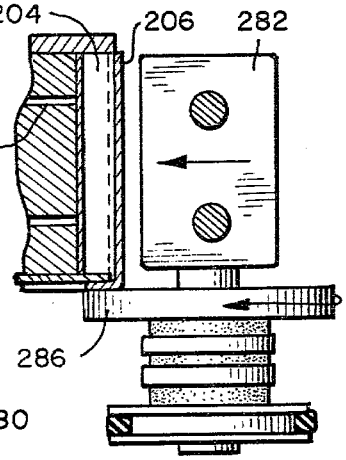
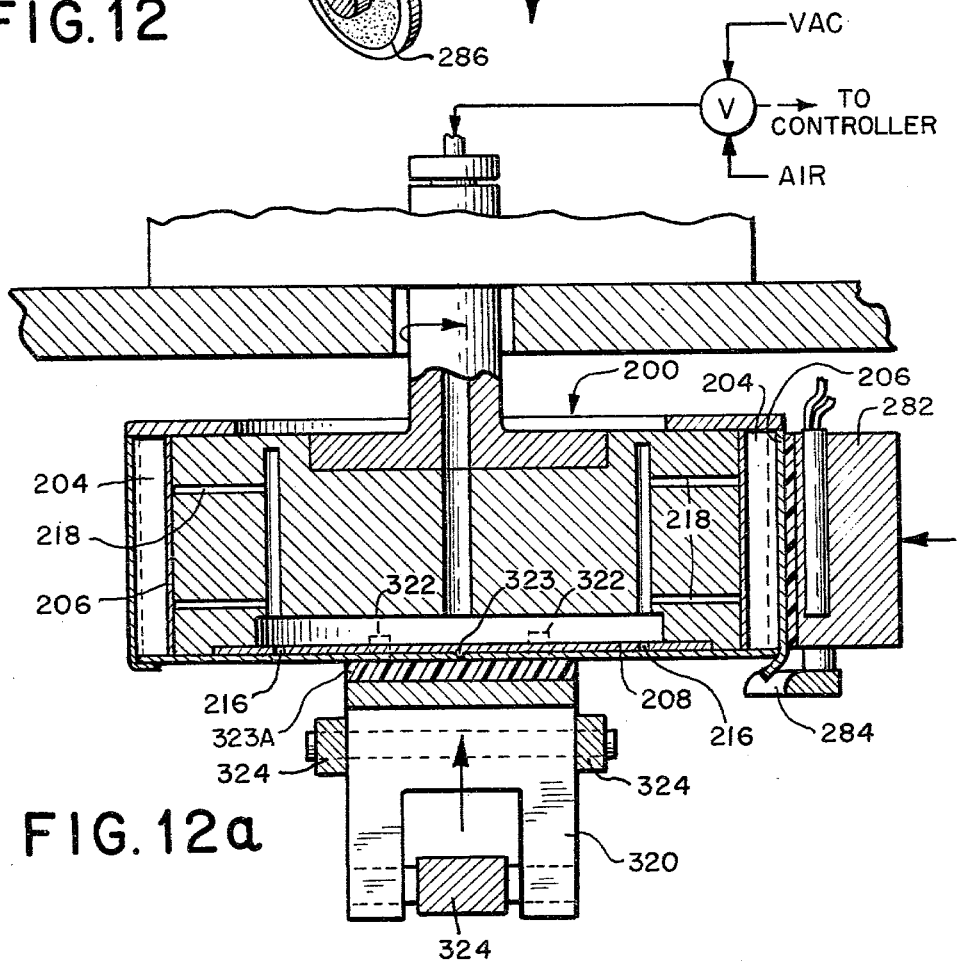
FIG. 12a

FIG. 13
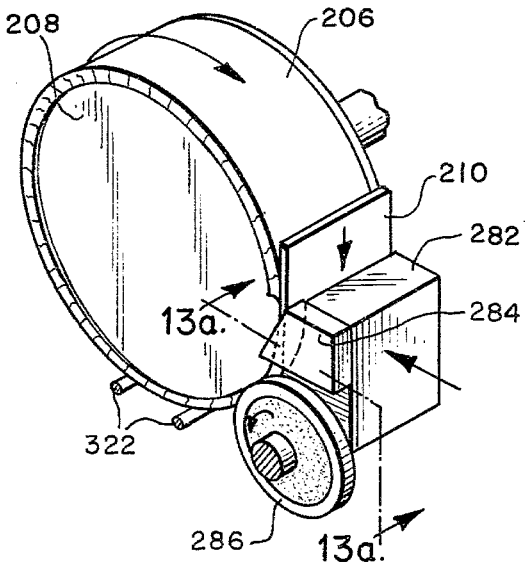
FIG. 13a
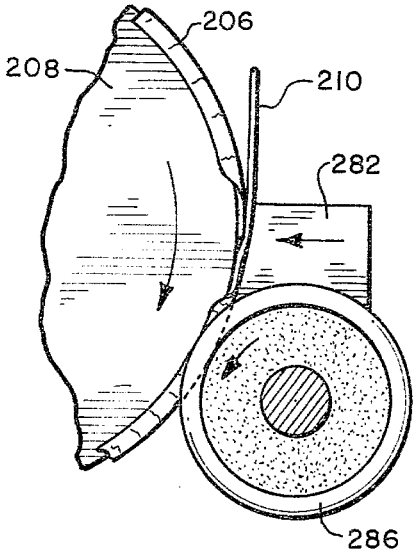
FIG. 14a
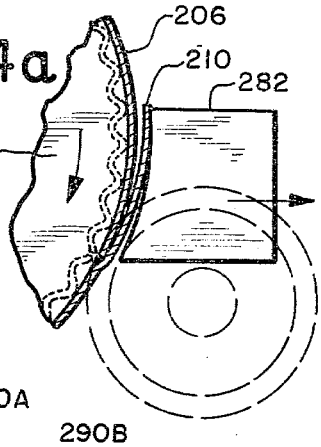
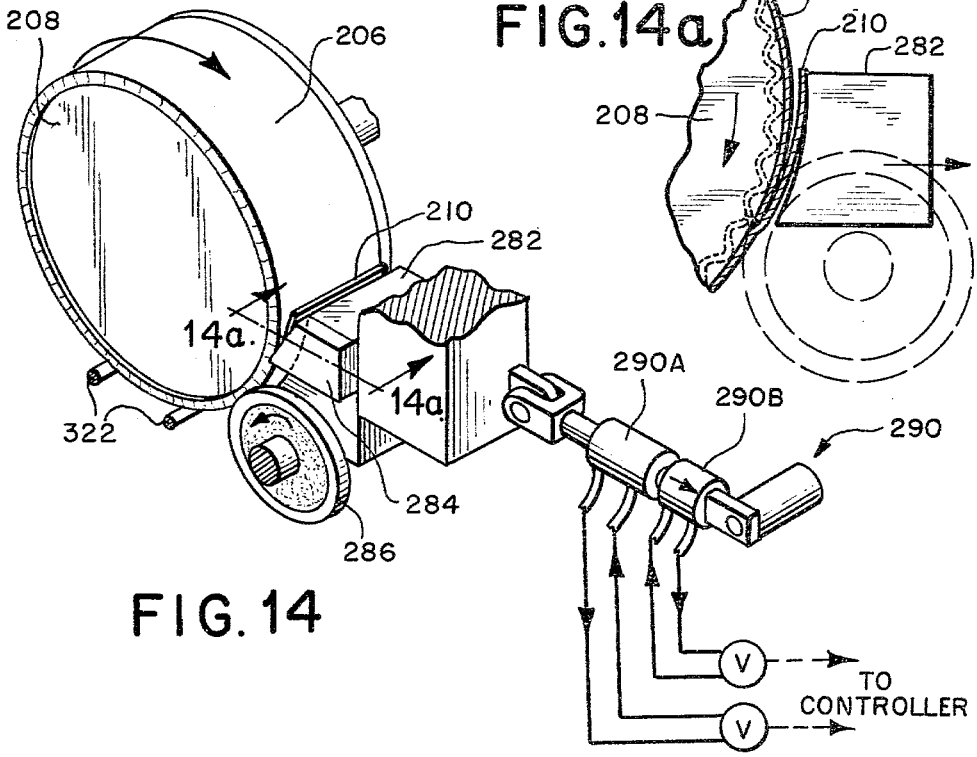
FIG. 14

APPARATUS FOR MAKING CORRUGATED PACKAGES

BACKGROUND AND SUMMARY OF THE INVENTION

The present invention is directed to a novel apparatus and method for making improved corrugated packages.

Corrugated packaging has been known for many years. However, there is a substantial need for a machine and a process which will produce improved corrugated packages of a selected size on a high volume basis from inexpensive starting materials. For example, in the food merchandising industry there is a need for a disposable paper package for use in making and shipping products such as layer cakes. Such a process and a machine should be capable of making the desired package from relatively inexpensive starting material, such as paper, to minimize the cost of the package to the consumer. The process and machine further should be capable of producing a completed package automatically, on a high volume basis and with minimum labor costs, to meet the need in industry for packages, and to diminish the per unit cost.

In accordance with this invention, the machine and process accommodates high-speed production of corrugated packages from inexpensive stock sheet material by functioning to automatically sequence the sheet material through steps which form a multiple-ply corrugated package side wall from the sheet material simultaneously with the formation of the package, so that completed packages can be discharged from the machine on a high volume basis. Speed is enhanced and costs are reduced by this machine and process by starting with flat stock sheet material which can be economically purchased in bulk. This flat material then is corrugated and formed into a package by the machine and process of this invention. The result is the high-speed production of uniform corrugated packages with efficiency and economy. Moreover, volume production can be increased further because the machine and process of this invention can be joined and operated in tandem or multiple-unit arrangements, so that a plurality of units work in unison to multiply the production capabilities of the machine and process.

Generally, the machine in accordance with this invention includes a rotatable corrugation head having a front face and a fluted periphery. This head is arranged to be rotated through several cycles of operation, with each cycle preferably encompassing one hundred and eighty degrees of rotation. The head incorporates means to secure material to its face and perpiphery during the operation of the machine. Preferably, the securing means includes vacuum ports in the periphery and the front face of the head which selectively apply a partial vacuum pressure or suction force to sheet material positioned adjacent the front face or the periphery, to thereby secure the material to the rotating head.

The machine also includes corrugating means, such as a movable corrugating roller, arranged to move into association with the head and mesh with the flutes on the head periphery. The roller and the head function to corrugate a sheet of material which is directed therebetween as the head is rotated. Actuation means, such as a pneumatic or hydraulic cylinder, are arranged for selectively moving this corrugating roller between a disengaged position and an engaged position mating with the fluted periphery of the head.

The machine also includes means for feeding an inner sheet of material of a selected length and width from a bulk material source into a position between the corrugating roller and the head. During operation of the machine, this sheet forms the inner corrugated ply of the side wall of the package. Suitable cutting means cut the inner sheet of material to a selected length after the leading edge of the material has been secured between the corrugating roller and the corrugation head. A sheet measuring and slack tape-on device is provided between the material source and the material feed to pre-measure the selected length of material to be fed, and to increase the accuracy of the feeding by isolating the material feed from the load of the bulk material source and by applying a linear tension force to the sheet.

A mechanism also is provided for placing a bottom wall member in association with the corrugation head, so that the function of the machine secures the bottom wall to the side wall as the side wall is being formed. In this respect, the machine includes means for transporting a bottom wall member having a selected shape and an outer edge from a supply source into engagement with the front face of the head, with the edge of the bottom wall aligned with the fluted periphery of the head. Means, such as the above-described vacuum ports, secure this bottom wall member for rotation with the corrugation head. Actuating means such as a pneumatic or hydraulic cylinder move the transport means between a disengaged position removed from the head, into an operating position which places the bottom wall member against the face of the head.

The machine in accordance with this invention also generally includes sealing means movable into association with the corrugation head for joining an outer sheet of material to the corrugated inner sheet. The outer sheet of material has a width greater than the width of the inner sheet, and a selected length, so that the outer sheet can be placed over the inner sheet to extend over the edge of the bottom wall member described above. Actuating means, such as pneumatic or hydraulic cylinders, selectively move this sealing means between a disengaged position and an operating position in association with the head.

The machine also has means for feeding a selected length of the outer sheet from a bulk supply source to a position between the sealing means and the head, for forming the outer sheet of the package and joining the corrugated side wall to the bottom wall upon rotation of the head. In the preferred arrangement, the actuating means for the sealer is arranged to clamp the leading edge of the outer sheet to the corrugating head, and the feeding means includes cutting means, to cut the outer sheet to a selected length after the material is so clamped. As described above with respect to the inner sheet, the feeding means for the outer sheet also includes measuring and slack take-up means arranged to provide a pre-measured material for said feeding means, and to isolate the feeding means from the load of the inner sheet bulk supply source.

In the preferred embodiment the engageable portions of the inner and outer sheet, and the bottom wall member, are provided with a heat seal coating, and the sealing means is a heat source which heats and seals the outer sheet to the inner sheet, and simultaneously seals the outer sheet to the bottom wall member, to form the corrugated side wall and the package simultaneously.

The sealing means also preferably includes means for folding and sealing the extending edge portion of the outer sheet against the bottom wall member to form a frangible joint along which the side wall comprising both the inner and outer sheets, can be readily removed from the bottom wall. The adjacent ends of the corrugated inner sheet are abutting but preferably not overlapping; to facilitate the removal of the side wall from the bottom wall. In the preferred embodiment, the sealing means also operates so that the outer sheet is sealed only to the bottom wall for a portion of rotation of the head, to form a relatively free pull tab portion on the side wall.

The machine in accordance with this invention also includes a mechanism for removing a completed package from the corrugation head. In the preferred form, this mechanism includes clamping means to grip the side wall of the package, preferably assisted by a vacuum force drawn through ports provided in the clamping means. The clamping means is driven, by pneumatic or hydraulic cylinders or other suitable means, to remove the package axially from the head, and then operates to discharge the package into a selected location, such as onto a conveyor belt for moving the packages to a subsequent operating station. This discharge of the package from the clamping means can be assisted by the reversal of the vacuum force in the ports of the clamping means, to apply a positive pressure force to the package. Additionally, the ports in the clamping means can be arranged at an angle to further assist the discharge of the package in the proper direction away from the corrugation head.

The method of forming a corrugated package in accordance with the present invention generally includes the steps of corrugating an inner sheet of material having a selected width on a rotatable corrugation head while forming the material into a shape defining a portion of the package side wall, and moving a bottom wall member adjacent the corrugated inner sheet so that an outer edge of the wall member is aligned with the corrugation portion of the inner sheet. An outer sheet of material having a width greater than the width of the first sheet is then wrapped around the corrugated inner sheet so that a portion of the outer sheet projects over the outer edge of the bottom wall. The outer sheet is then simultaneously joined with the corrugated portion of the inner sheet and the bottom wall member so that the outer sheet forms an outer ply of the side wall and joins the side wall of the package to the bottom wall. The method thereby forms a corrugated side wall and forms the package substantially simultaneously. In the preferred arrangement, several additional steps are included to perform the above-noted method in a preferred manner, to provide the package with a pull tab and to otherwise facilitate removal of the side wall from the bottom wall. The method concludes with discharging the completed package from the corrugation head.

DESCRIPTION OF A PREFERRED EMBODIMENT

Further advantages and features of the apparatus and method of the present invention will become more apparent from a description of a preferred embodiment thereof, adapted to produce a cylindrical corrugated package for use in containing and shipping layer cakes. Of course, it will be appreciated that the apparatus may be provided with change parts, to produce packages of different shapes and sizes. The preferred embodiment of the apparatus and method is set forth in the following description, and is shown in the acoompanying drawings, in which.

Figure 7:
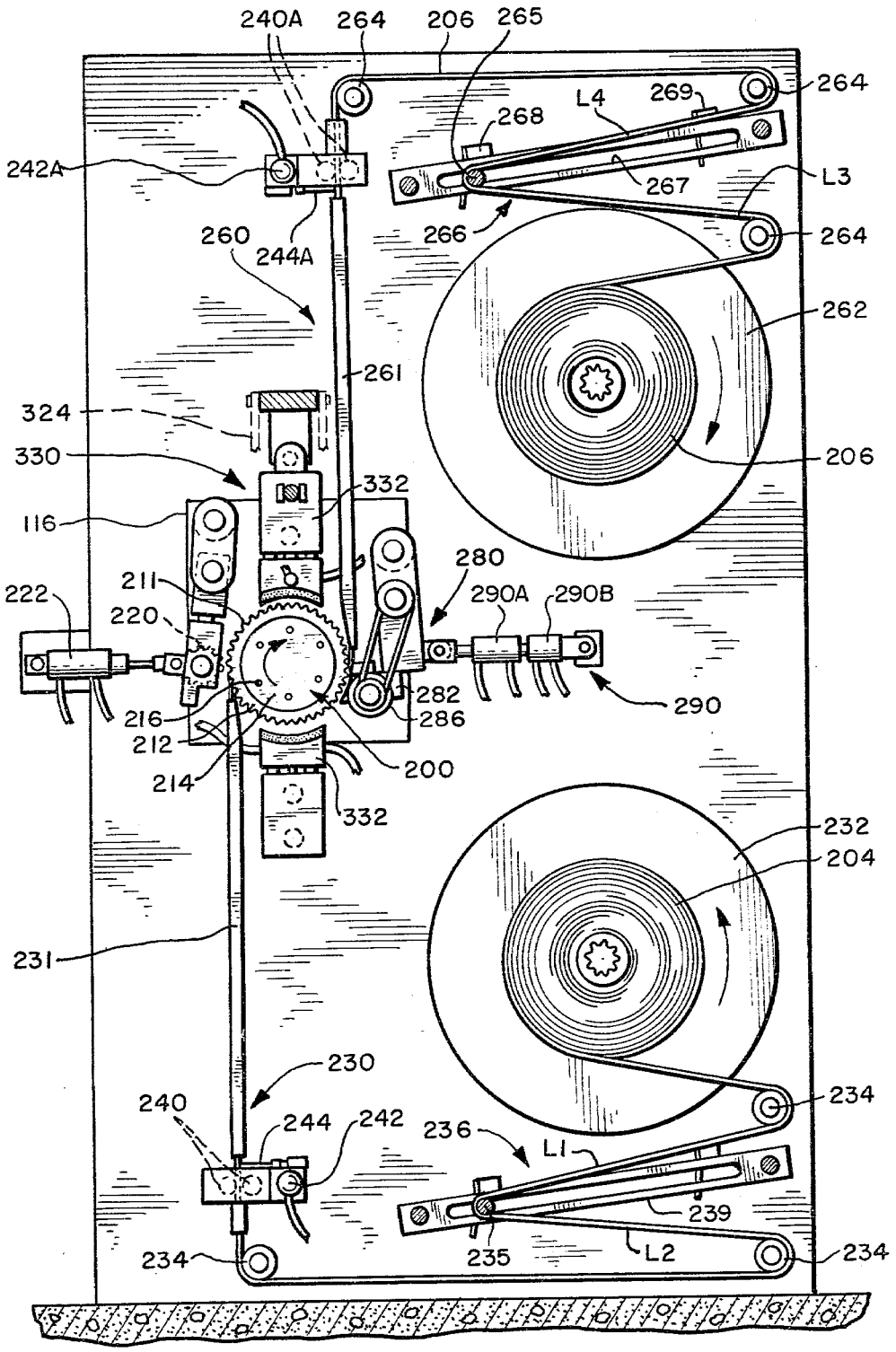
FIG. 7 is an elevational view of one of the operating units of the machine of the present invention, shown with portions removed for clarity.
Figure 8:
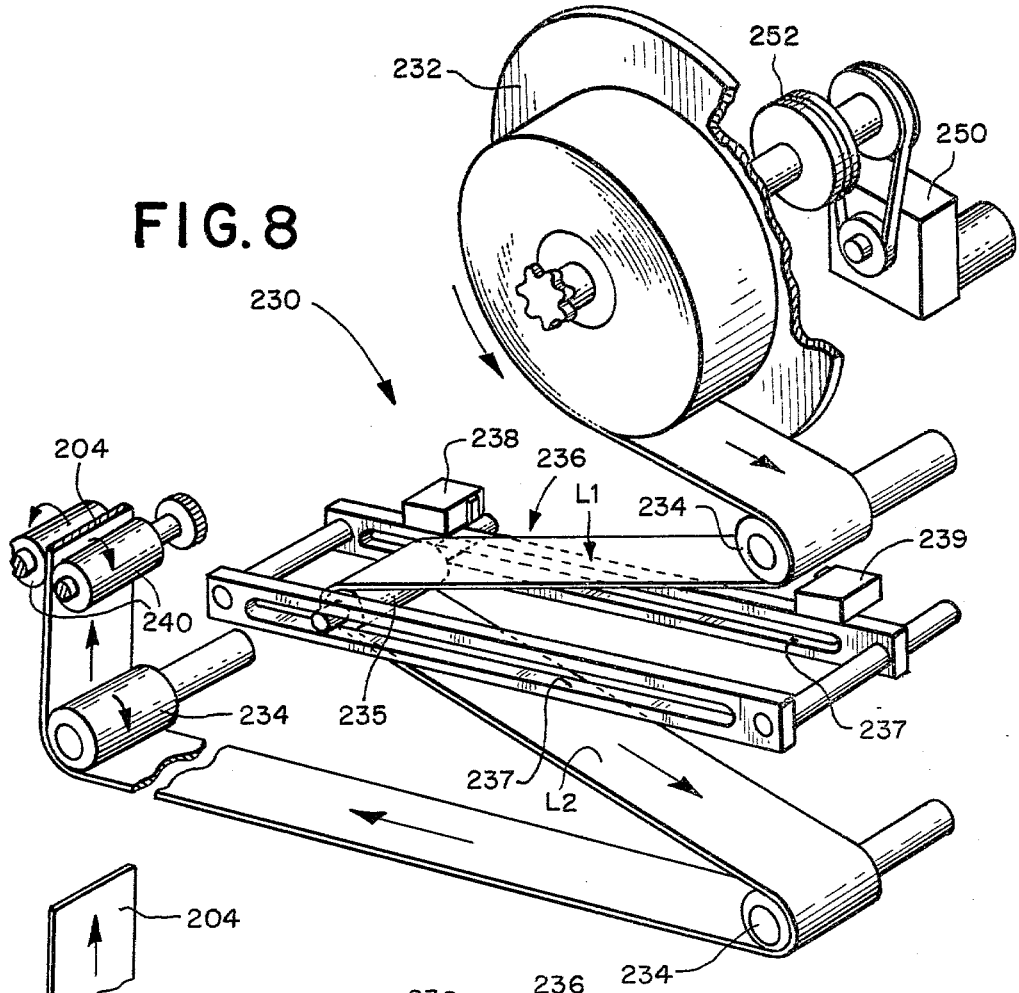
FIG. 8 is a perspective view of the inner sheet feeding mechanism incorporated in the machine for feeding a selected length of inner sheet material to be corrugated from a bulk supply reel through a measuring and slack take-up device, shown in a position before the feeding operation is begun.
Figure 8A:
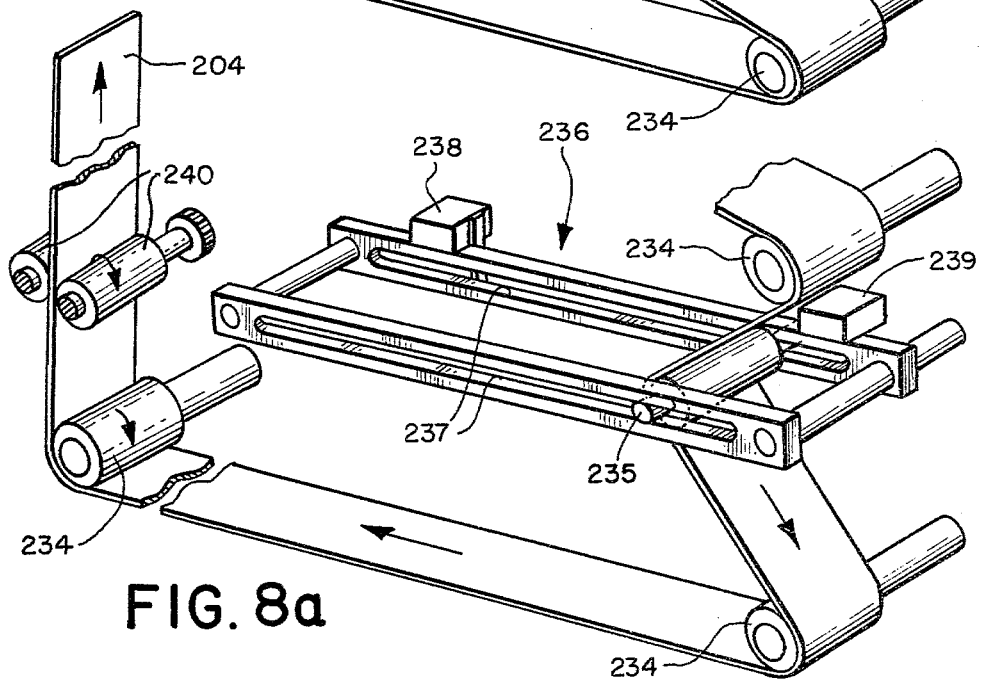
Figure 9:
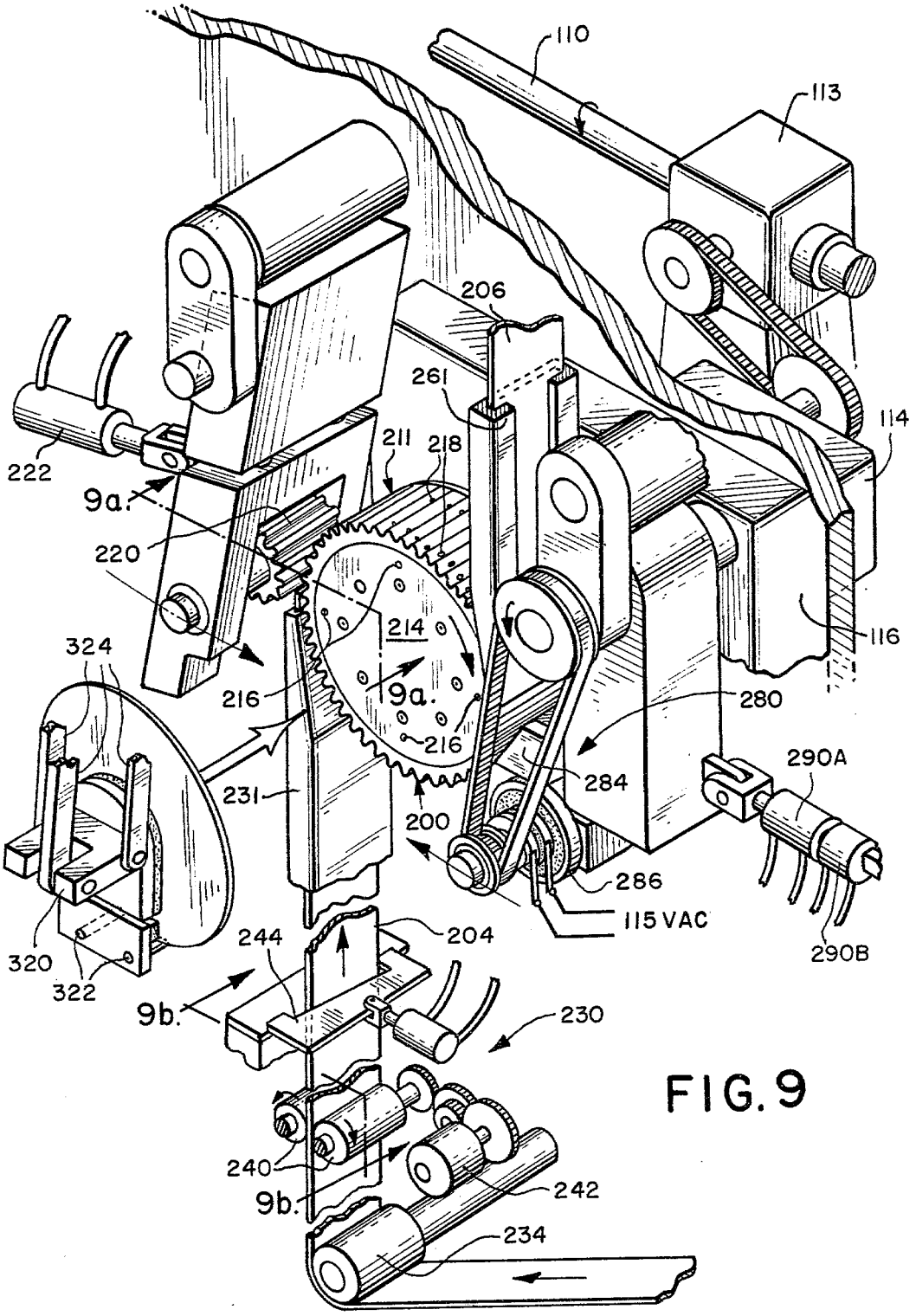
Figure 10:
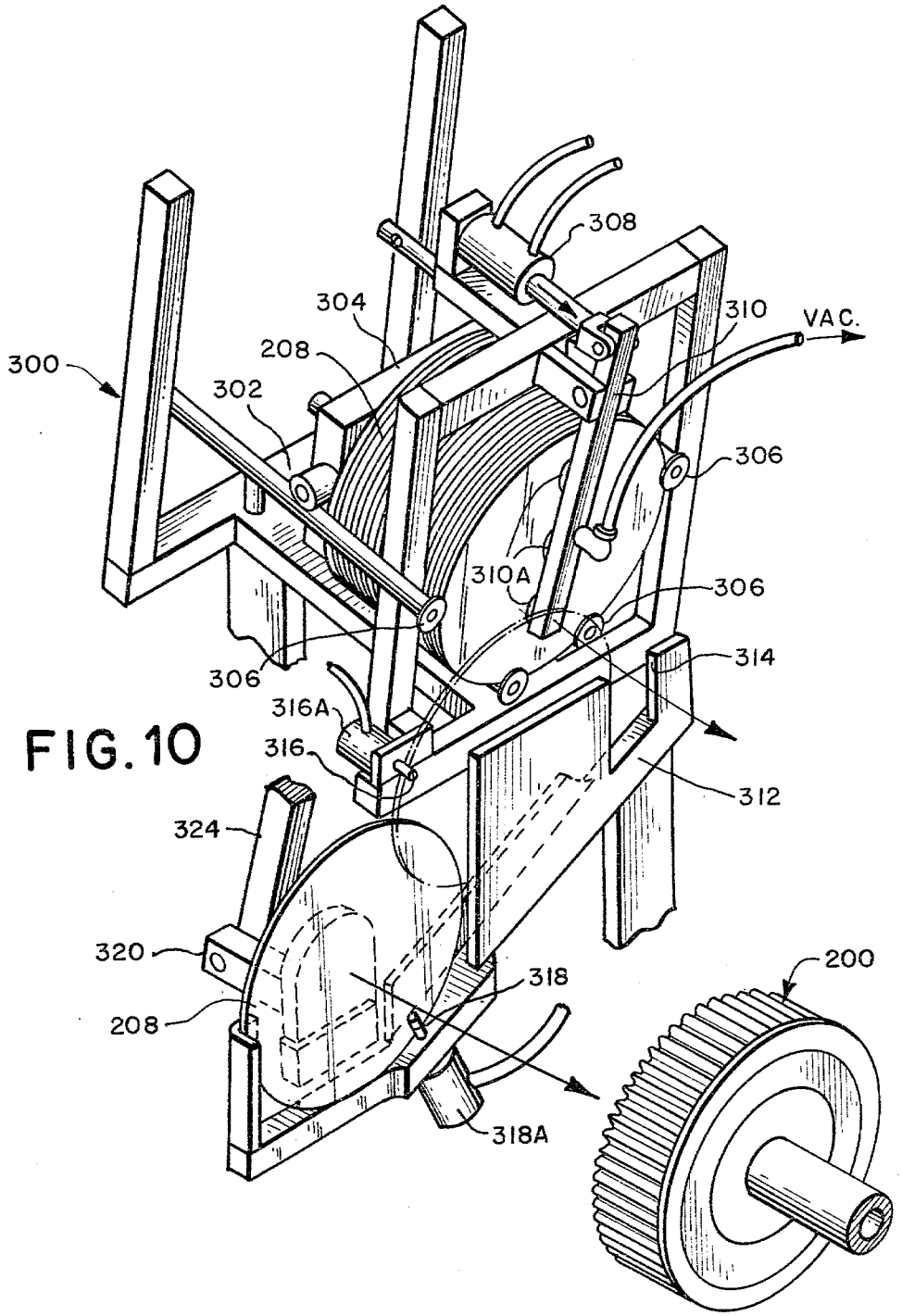
Figure 11:
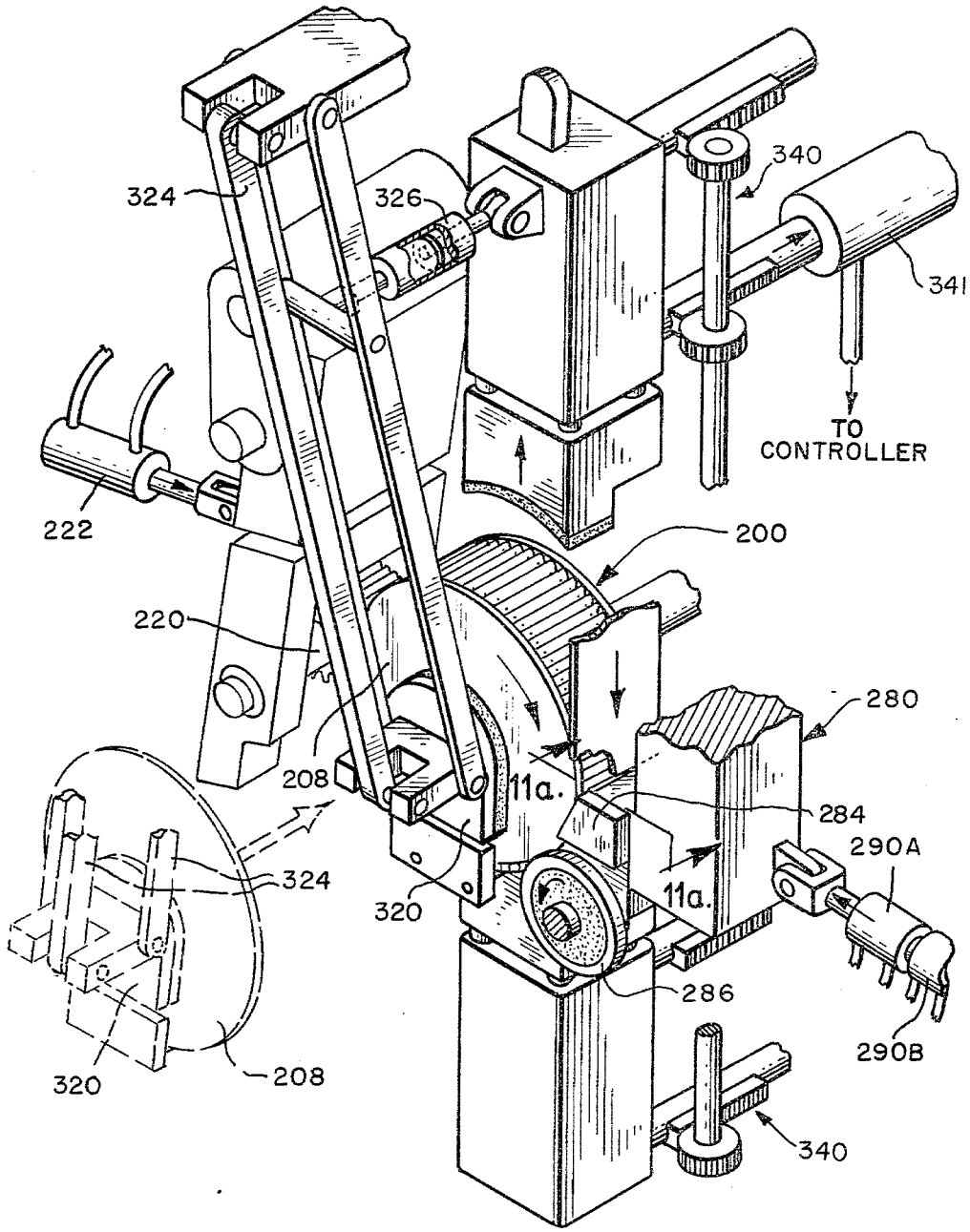

FIG. **8*a* is a perspective view of a portion of apparatus shown in FIG. 8**, showing the device in a second position after a selected length of material has been fed from the supply reel;

FIG. 9 is a perspective view of a portion of the operating unit illustrarted in FIG. 7, showing the detailed arrangement of some of the operating components of the machine with respect to the rotating corrugation head as the corrugation of the inner sheet is begun;

FIG. **9*a* is a cross-sectional view of the machine taken along the line 9*a*—9*a* in FIG. 9**, illustrating the manner in which the leading edge of the inner sheet is clamped between the corrugation head and a corrugating roller, to begin the operation of corrugating the inner sheet;

FIG. **9*b* is a cross-sectional view of a portion of the inner sheet feeding mechanism of the machine, as viewed along the line 9*b*—9*b* in FIG. 9**, illustrating the manner in which the inner sheet is cut to a selected length;

FIG. 10 is a perspective view of the mechanism provided on the machine in accordance with this invention for maintaining a supply of bottom wall members adjacent the operating unit, and for feeding bottom wall members individually from the illustrated outward or disengaged position into engagement with the rotating corrugation head;

FIG. 11 is a perspective view of a portion of the mechanism for transporting bottom wall members to the corrugation head showing the transport mechanism in the inward position with the bottom wall member engaged with the head, and further showing clamping means for removing the completed package from the head and sealing means associated with the head;

FIG. 11*a* is a partial sectional view taken along the line 11*a*—11*a* in FIG. 11, illustrating the relationship between the inner and outer sheets as the outer sheet is clamped between the corrugation head and the movable sealing means;

FIG. 12 is a perspective view of the corrugation head after two cycles of operation each comprising one hundred and eighty degrees of rotation of the head, showing the feeding of the outer sheet between the corrugation head and sealer, and the resulting joinder of the outer sheet to the corrugated inner sheet and to the bottom wall member;

FIG. 12*a* is a sectional view of the corrugation head and sealer transport device for the bottom wall members, taken along the line 12*a*—12*a* in FIG. 12, illustrating the clamping of the outer sheet to the inner sheet by the sealer; the positioning of the bottom wall member onto the head by the wall transport device; and the ports for applying a vacuum or suction force to the sheets and bottom wall through the head;

FIG. 12*b* is a partial sectional view taken along the line 12*b*—12*b* in FIG. 12, illustrating the relationship between the sealer and the rotating corrugation head when the sealer is in the inward engaged position;

FIG. 13 is a perspective view of the rotating corrugation head and the sealer with the sealer in the engaged position to complete the sealing of the outer sheet to the inner sheet and the bottom wall member;

FIG. 13*a* is a partial sectional view taken along the line 13*a*—13*a* in FIG. 13, illustrating the sealing of the outer sheet to the inner sheet and the bottom wall member with the sealer in the inward engaged position;

FIG. 14 is a perspective view of the rotating corrugation head and sealer with the sealer in a partially retracted position so that the tear tab in the preferred form of the package is created by the sealing of the outer sheet only to the bottom wall member.

Figure 15:
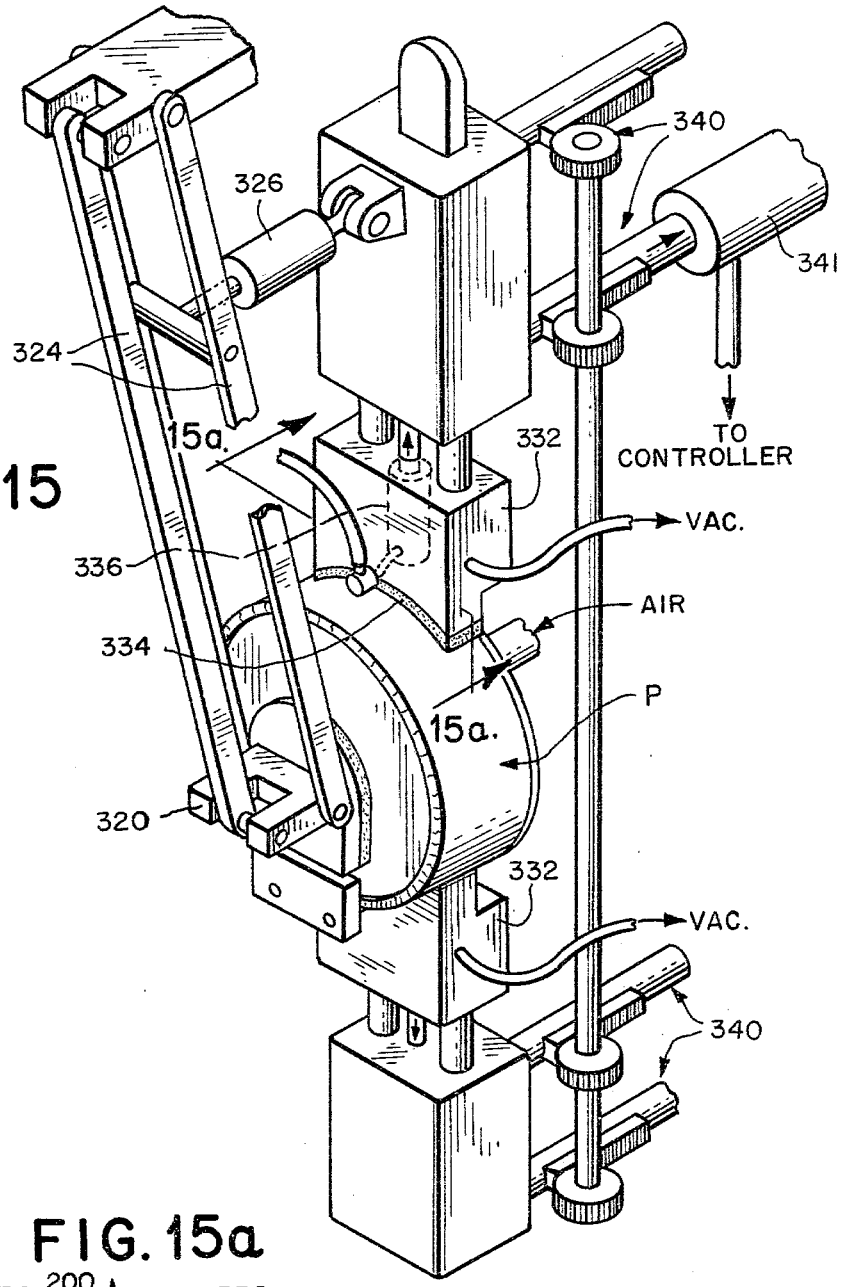
Figure 15A:
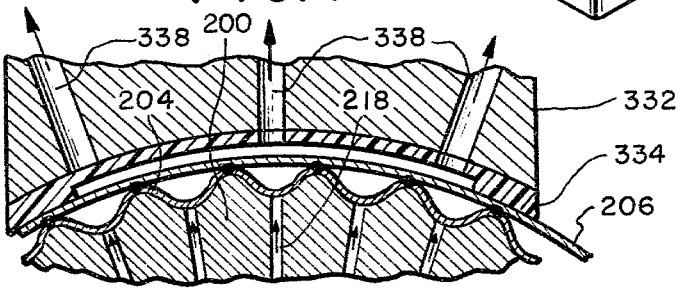
Figure 16:
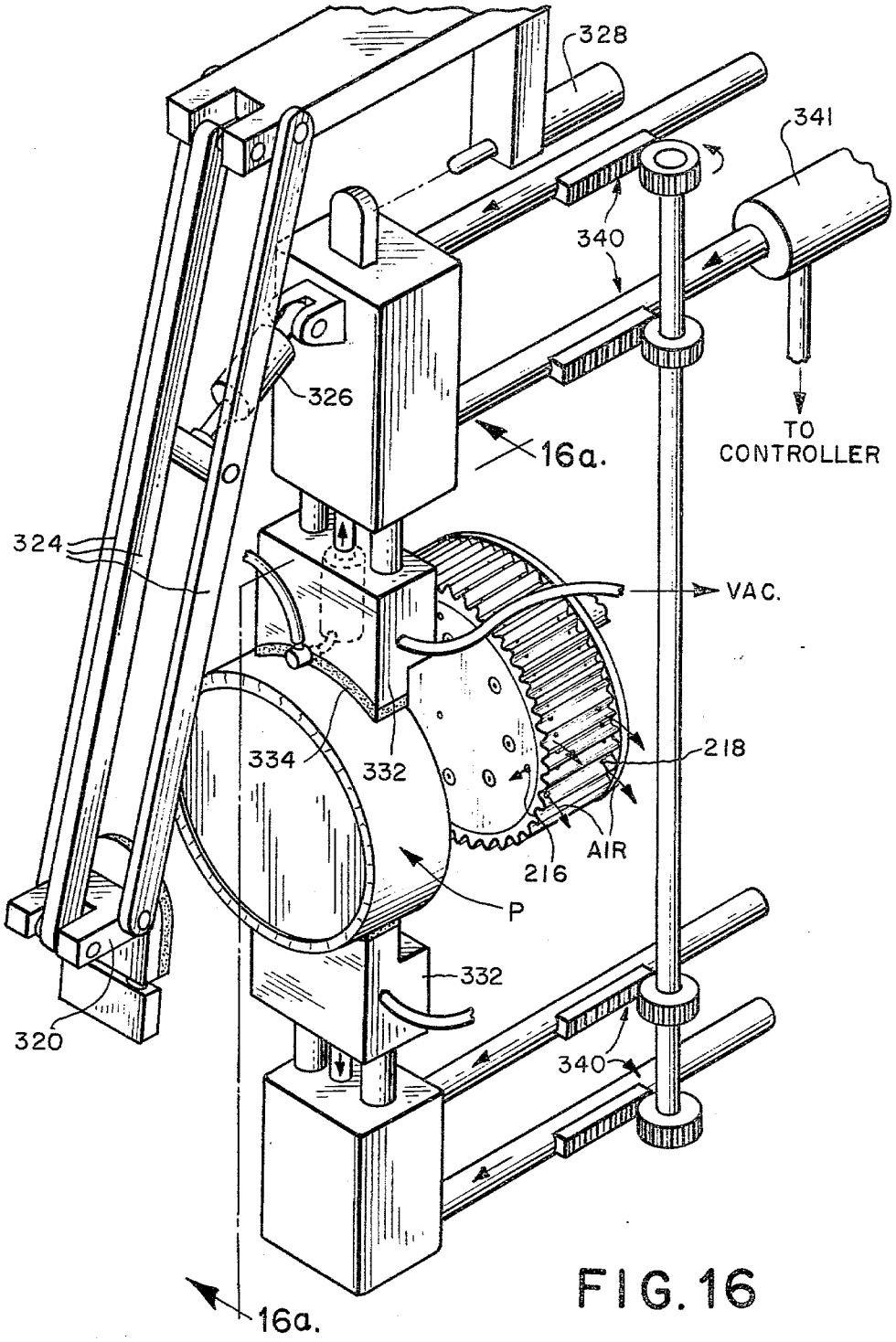
Figure 17:
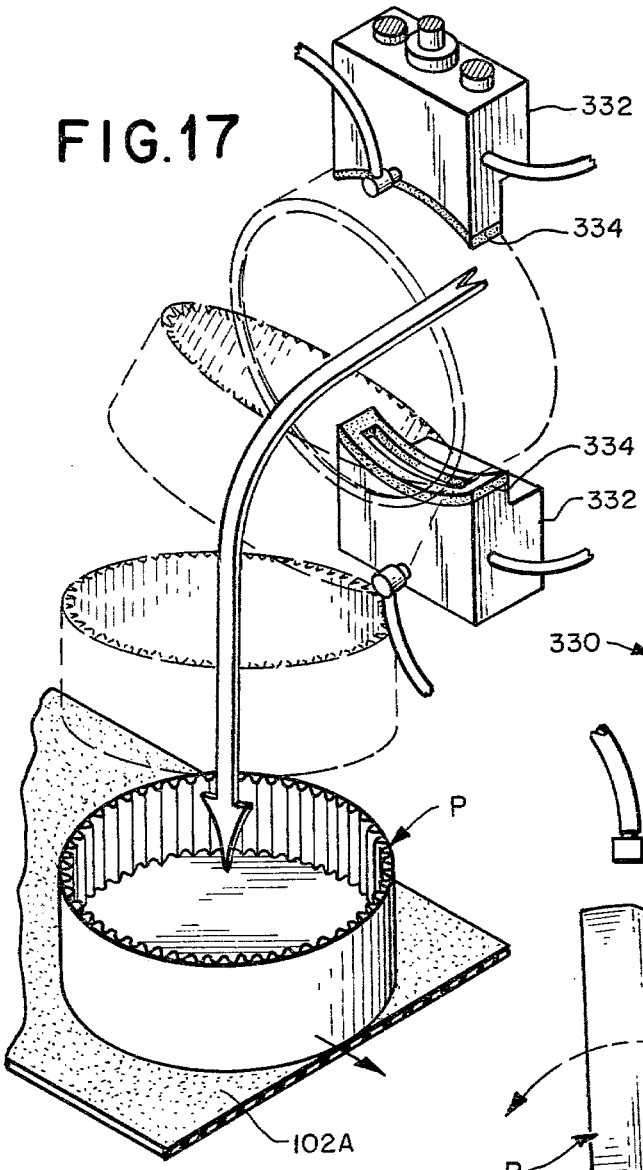
Figure 16A:
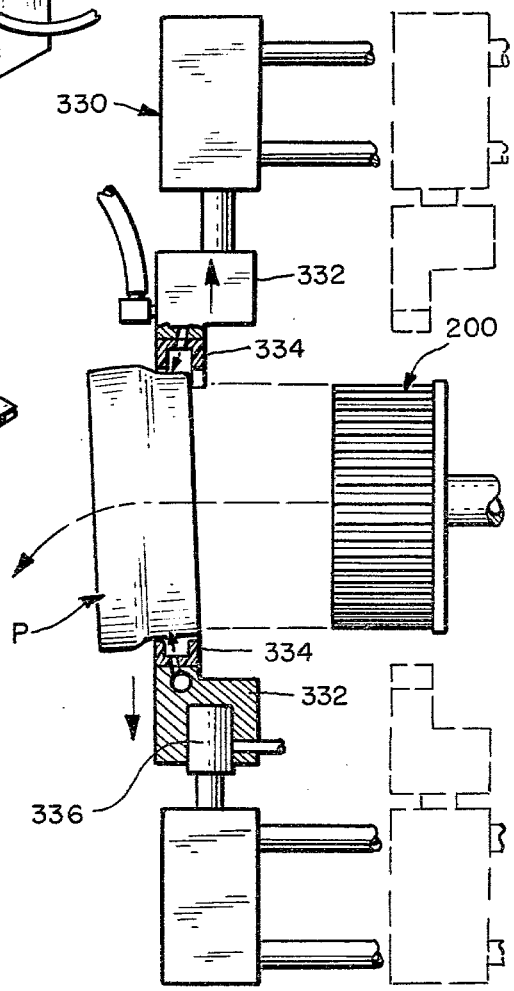

FIG. 14*a* is a partial sectional view taken along the line 14*a*—14*a* in FIG. 14, illustrating the relationship between the corrugation head and the sealer with the sealer in a partially retracted position;

FIG. 15 is a perspective view showing the transport device for the bottom wall members and further showing the clamping device incorporated in the machine in a clamped condition to remove the completed package from the corrugation head;

FIG. 15*a* is a partial sectional view taken along the line 15*a*—15*a* in FIG. 15, illustrating the arrangement of the vacuum ports provided in the clamping device shown in FIG. 15;

FIG. 16 is a perspective view similar to FIG. 15 but showing the clamping device in a forward position for removing the package from the corrugation head;

FIG. 16*a* is a partial view taken along the line 16*a*—16*a* in FIG. 16, illustrating the engagement between the clamping device and the completed package upon removal of the package from the corrugation head; and FIG. 17 is a perspective diagrammatic view illustrating the manner in which the completed package may be forceably discharged from the clamping device onto a suitable conveyor, for movement to a subsequent operating station or to storage.

Figure 1:
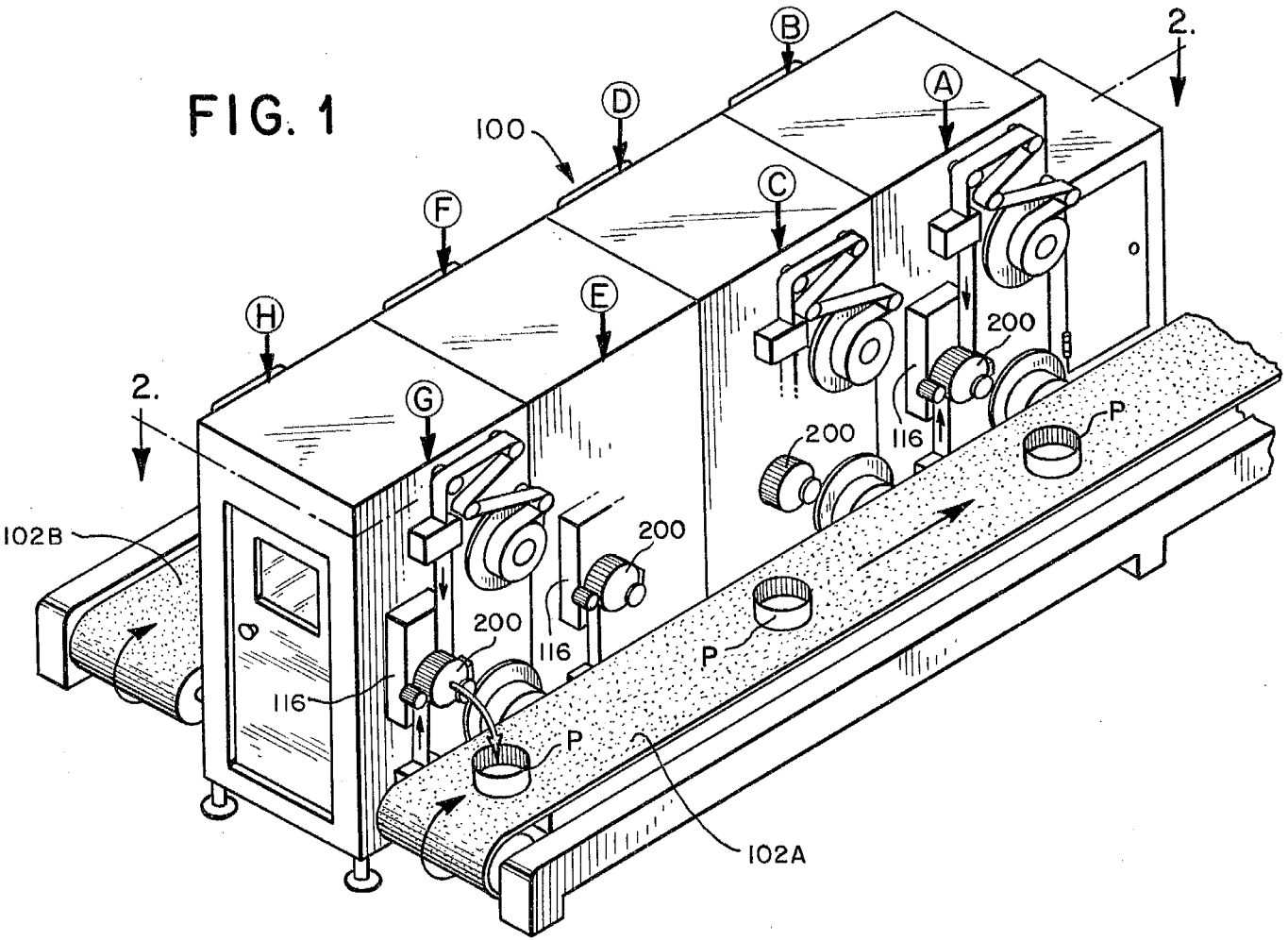
FIG. 1 is a perspective view of the general arrangement of a multi-unit machine for making corrugated packages in accordance with the present invention.

As stated above, the illustrated machine embodying the features and advantages of the present invention is adapted to make cylindrically-shaped corrugated layer cake packages on a high-speed assembly line basis. Such a machine is indicated generally in FIG. 1 by the reference numeral 100. The illustrated machine 100 is composed of eight identical units A–H, integrated to operate as a single machine with co-ordinated power inputs, controls and production outputs. This machine 100 includes a pair of suitable conveyors 102A–B, as illustrated in FIG. 1, for receiving the completed packages P from each of the units A–H during the operation of the machine 100. Of course, it will be appreciated, that the features and advantages of the present invention can be embodied in a machine formed from one or more of the units A–H. Hence, the detailed description of the units set forth below will be confined to the description of one of the units A. Any additional units would be identical in construction, and would use the same operating method. Also, it is apparent that a high-production machine can be made to incorporate the features and advantages of the present invention by using a larger number of units than the eight units illustrated in FIG. 1.

Figures 2, 3, 4, 5, 6:
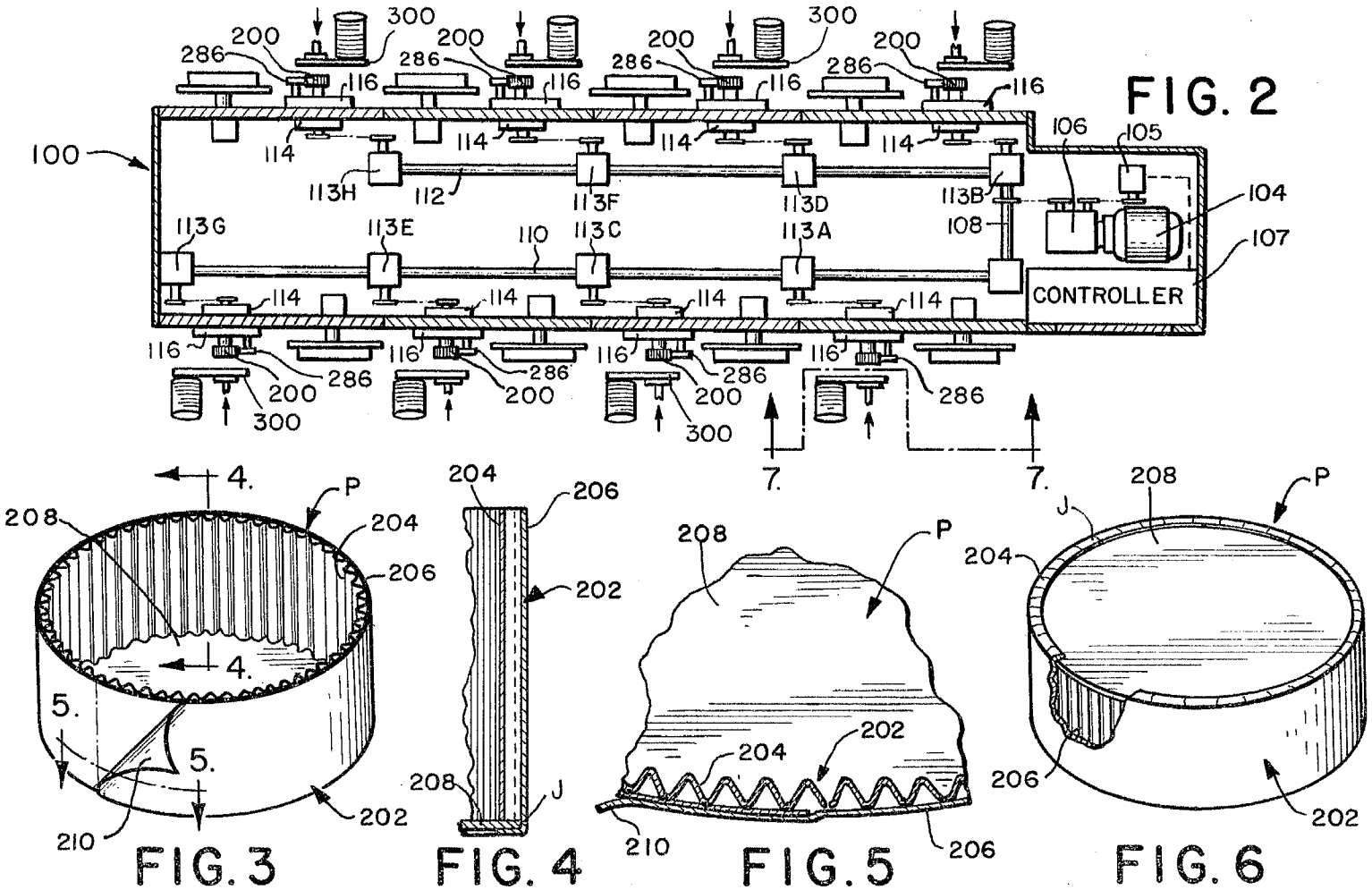
FIG. 2 is a sectional view of the multi-unit machine taken along the line 2—2 in FIG. 1.
FIG. 3 is a perspective view of the cylindrical corrugated layer cake package which is produced by the preferred embodiment of the machine and method in accordance with the present invention.
FIG. 4 is a sectional view of the corrugated side wall and bottom wall portion of the package, taken along the line 4—4 in FIG. 3.
FIG. 5 is a partial sectional view taken along the line 5—5 in FIG. 3, illustrating the details of the side wall and pull tab portion which can be produced by the machine and method in accordance with the present invention.
FIG. 6 is a a perspective view of the package produced by the machine and method of the present invention, as seen from the bottom side thereof, with a section of the side wall removed to illustrate the joining of the outer and inner sheets to form the corrugated side wall, and the folding over and joining of the outer sheet with respect to the bottom wall member of the package.

The common drive and controls for the multiple units of the machine 100 are illustrated generally in the cross-sectional view of FIG. 2. As shown in FIG. 2, the machine 100 includes a suitable electric drive motor 104. This motor 104 is connected by a variable speed gear reducer 106, and a chain drive or the like, to a main drive shaft 108. In one particular embodiment, the motor 104 can be an electrical motor in the 3 horsepower range, and the output of the gear reducer 106 can be in the 8 to 25 R.P.M. range. Of course, other drive means can be provided by those skilled in the art without departing from this invention.

The main shaft 108, in turn, is connected, through suitable gearing, to a left-hand drive shaft 110 and a right hand drive shaft 112 (as viewed from the right in FIG. 2). The shafts 110 and 112 drive rotatable corrugation heads 200, and other components of the individual units A–H, through direction-changing gear boxes 113A–H, as shown in FIG. 2. The gear boxes 113A–H drive indexers 114 on each unit. Each indexer 114, in turn, is connected to a final drive gear box 116 which drive the associated corrugating head 200 and the heat sealer 286. Although many suitable drive arrangements may be devised by those skilled in the art, one desirable arrangement is for the indexers 114 to have an intermittant output which produces two complete revolutions of the heads 200 for each input revolution of the drive shaft 110 or 112. As explained further below, in this manner each revolution of the input shaft 110 or 112 will therefore produce one completed corrugated package P. The indexers 114 and the final drive gear boxes 116 are also employed to intermittantly drive a rotating portion 286 of the heat sealer 280 for each unit A–H, as described further below. A suitable indexer for this purpose is the "Cyclo Index", sold by the Hilliard Co. of Elmira, N.Y.

The improved form of package P is illustrated in FIGS. 3–6. A two-ply side wall 202 is constructed from a corrugated inner ply 204 and a flat outer ply 206. Each ply is made from a sheet of flat stock material, and the corrugated side wall 202 is formed at the same time as the package P is being made by the machine 100. A circular bottom wall member or disc 208 is joined to the side wall 202 against the lower edge of the corrugated wall 202. The shape of the preferred package shown in FIGS. 3–6 is cylindrical. Of course, this shape can be varied, and is a function generally of the shape of the corrugation head 200.

The package P also preferably is provided with a pull tab 210 which comprises a portion of the outer sheet 206 connected only to the bottom wall 208. The pull tab 210 and the construction of the package make the side wall 202 readily removable from the bottom wall 208. As shown in FIG. 5, the ends of the inner corrugated sheet 204 are abutted but not joined or overlapped in the preferred arrangement. Thus, the inner sheet 204 need not be torn or broken when the side wall 202 is separated from the bottom wall 208. This arrangement facilitates the use of the package P for serving food items such as cakes. When the cake is ready for consumption, the side wall 202 can be removed from the package P by pulling the pull tab 210 away from the bottom wall 208. The cake can then be served, if desired, on the bottom wall 208. FIG. 6 illustrates the preferred form of joining the side wall 202 to the bottom wall 208 comprising folding over a portion of the outer sheet 206 against the bottom wall 208 to restrain the bottom wall from downward movement, and sealing that folded portion to the bottom wall. Such a construction forms a frangible joint J (see FIGS. 4 & 6) around the edge of the bottom wall 208. Hence, the corrugated inner wall 204 adds rigidity to the side wall 202, but does not interfere with the removal of the side wall by the tearing of the outer wall 206 along this joint.

The engaged portions of the illustrated inner and outer sheets 204 and 206, and the bottom disc 208 are provided with a heat sensitive coating so that they will be self-adhering upon the application heat. A suitable form of paper for the inner sheet 204 has been found to be 40 pound base weight bleached kraft paper coated on the inside with polypropylene and on the outside with polyethylene. The outer sheet 206 can be, for example, 30 pound wet strength bleached kraft paper which is coated on the inside with polyethylene. The bottom disc 208 can be solid bleached kraft paper coated on both sides with polyethylene.

Although other forms of coatings or adhesives can be employed to make a package in accordance with this invention, the above-noted coatings have been found to be useful and preferred for high-speed manufacturing of packages. The melting point of the polyethylene coating is about 230° F., and the melting point of the polypropylene coating is higher, at about 280° F. By this preferred arrangement, the package P can be sealed with the application of heat of an effective temperature between this range, e.g., 230°–280° F. Since the machine 100 will arrange the sheets 204 and 206 and the disc 208 such that the respective polyethylene coatings are engaged, the application of heat in such a range will melt and seal the polyethylene together, without melting the polypropylene coatings on the disc 208 and the inner sheet 204. The polypropylene coatings thus remain intact, and can function as a barrier to the penetration of liquids, such as grease and the like, when the package P is used for food items such as cakes.

Some of the major components included in each of the operating units A–H in accordance with this invention are illustrated in the elevational view of FIG. 7. As shown therein, each operating unit includes a rotatable corrugation head 200 which, as shown in FIG. 2, is arranged to be intermittantly driven by the drive motor 104 through the indexer 114 and the final gear drive 116. Each head 200 includes a continuous outer periphery 211 having a selected width and provided with undulating flutes 212. These flutes 12 are adapted to form corrugations in sheet material which is secured to the head 200. The head 200 also includes a front face portion 214 which is disc-shaped and adapted to receive a bottom wall disc 208 during the operation of the unit.

Ports 216, as shown in FIG. 7, are provided in the face of the head to secure the disc 208 to the head. These ports 216 are shown in more detail in FIGS. 9 and 16. The periphery 211 of the head 200 is also provided with a series of ports 218, as shown in FIGS. 9, 9*a* 12*a*, 15*a* and 16. As shown clearly in FIG. 12*a*, the head 200 is connected to a vacuum supply 'V' so that a partial vacuum pressure can be applied to create a suction force through the ports 216 and 218. As described above, the function of this vacuum force is to secure the bottom disc 218 to the face 214, and to secure the inner sheet material 204 to the periphery 211 of the head 200 during the operation of the machine. These ports 216 and 218 are adapted to receive positive air pressure during certain phases of the operation on the unit, to assist in removing the completed package P from the corrugation head 200.

As shown clearly in FIGS. 7, 9 and 9*a*, each of the units A–H also includes a movable corrugation means in the form of a fluted corrugating roller 200. This roller 200 is positioned in a selected position on the machine adjacent the head 200, and is pivotable from a retracted position, as shown in FIG. 7, into an engaged position, as shown in FIG. 9 *a* and 9, wherein the head 200 and the roller 220 clamp the sheet 204. Actuating means in the form of a pneumatic or hydraulic cylinder 222 or the like is provided to selectively move the corrugating roller 220 between the disengaged and the inwardly engaged position.

FIGS. 7, 9 and 9*a* also illustrate that the machine includes a feeding mechanism 230 for feeding the inner sheet 204 of a selected width and length to the head. The sheet feeding mechanism 230 includes a supply reel 232 which contains a roll of inner sheet material 204. This sheet material 204 feeds off the reel 232 around idler rollers 234 and a measuring and slack take-up device 236, into a paper feeding tray 238. As shown in FIGS. 7 and 9*a*, the tray 238 directs the inner sheet material 204 upwardly between the corrugation head 200 and the corrugating roller 220. An accurately measured length of the sheet 204 is fed upwardly in this manner by the operation of a pair of frictional feed rollers 240, as shown in FIGS. 7 and 9*b*. The feed rollers 240 have a non-slip friction surface, so that the rotation of the rollers through a known degree accurately feeds a known length of sheet material 204. A feed drive motor 242 is connected to a control system for the machine and can be energized to drive the rollers 240 for the proper duration to drive a precisely measured length of material 204 upwardly toward the corrugating head 200. To accomplish such feeding, the drive motor 242 in the preferred embodiment is an electric stepping motor with a digital memory. As known to those skilled in the art, such a stepping drive motor 242 turns the motor shaft a known degree in response to the receipt of a selected electrical pulse signal. One suitable stepping motor to perform these functions is sold as the "Slosyn Preset Indexer" by Superior Electric Corp. of Bristol, Conn.

A knife blade 244 is connected to the feeding mechanism 230, as shown in FIGS. 7 and 9*b*, to sever the inner sheet 204 after a selected length has been fed upwardly to the head 200, and clamped into position between the head 200 and the roller 220. A hydraulic cylinder 246 or other suitable means is connected to the knife 244, and is selectively energized to perform this cutting operation.

The measuring and slack take-up mechanism 236 incorporated in the feeding mechanism 230 is illustrated in more detail in FIGS. 8 and 9*a*. The purpose of this slack take-up mechanism 236 is to isolate the feed rollers 240 from the load of the reel 232 and to apply a linear tensioning force to the sheet of material. The friction feed rollers 240 can thus accurately meter a selected length of material 204 toward the head 200 without having to overcome the inertial effects of the roll of stock material and the reel 232, and without having to compensate for a variable tension on the sheet. To isolate the feed rollers 240 in this manner, the feeding mechanism 230 includes fixed idlers 234, and a movable take-up roller 235. As shown in FIG. 8, the roller is arranged to travel longitudinally in an inclined track 237 by the force of gravity, and to engage the sheet material 204 to establish a material loop with a selected length defined by the two leg portions $L_1$ and $L_2$ between the rollers 234 and 235. When this loop ($L_1$, $L_2$) is established, as shown in FIG. 8, the length of the loop is chosen to be substantially equal to the desired length of material to be fed upwardly by the feed rolls 240 toward the corrugation head 200. Moreover, since the roller 235 is subjected to a constant gravitational force, the roller, in turn, applies a substantially constant linear tensioning force to the sheet material loop.

This loop length ($L_1$, $L_2$) is established by providing limit switches 238 and 230 on the track 237 which are engaged by the slack take-up roller 235 as the roller moves in the track. As seen in FIG. 7, this track is inclined downwardly toward limit switch 238, by an angle of approximately 15 degrees from the horizontal, so that the movement of the roller 235 toward the switch 238 is caused instead by the force of gravity. The reel 232 includes a drive motor 250 and a brake 252 connected to a suitable control system which actutes the motor 250 when the upper switch 239 is energized by the roller 235. Upon activation, the motor 250 drives the reel 232 counterclockwise in FIGS. 7 and 8, to unwind the material 204 from the reel, and to thereby establish the loop ($L_1$, $L_2$). The feeding of the material 204, plus the effect of gravity. cause roller 235 to move down the track 237 and create the loop ($L_1$, $L_2$) before engaging with the limit switch 238. A signal is generated by the switch 238 which stops the reel drive motor 250, and in addition energizes the reel brake 152. The loop ($L_1$, $L_2$) is created, and the feeding mechanism 230 is thereby prepared to feed a measured length of material 204 to the corrugation head 200.

When the feed rollers 240 are actuated with the above-identified arrangement, the rollers 240 need to overcome basically only the weight of material 204 and the weight of the slack take-up roller 235. The roller 235 applies a linear tension force to the sheet material during the feeding operation. As the feeding operation progresses, the loop of the material ($L_1$, $L_2$) is drawn through the feeding rollers, and roller 235 is driven upwardly along the track 237. Engagement of the second limit switch 239 by the roller 235 creates a signal which again activates the reel drive motor 250 and releases the brake 252, so that the loop ($L_1$, $L_2$) can be re-established by the slack take-up device 236. The feeding mechanism 230 for the inner sheet 204 is thereby positioned for the production of an additional package.

Each of the units A–H, as shown in FIG. 7, includes a feeding mechanism 260 for the outer sheet material 206, comparable in construction and operation to the above-described feeding mechanism 230 for the inner material 204. Accordingly, each unit is provided with a supply of sheet material 206 on a reel 262, which is fed from the reel toward the head 200 around fixed idlers 264. A measuring and slack take-up device 266 is provided between the reel 262 and the head 200, and functions in the same manner as described above with respect to the slack take-up device 236. The device 266 thus includes a pair of limit switches 268 and 269, and an inclined track 267 along which a slack take-up roller 265 travels to establish a loop ($L_3$, $L_4$) of material 206, and apply a linear tensioning force to the material. The length of the loop ($L_3$, $L_4$) is approximately equal to the selected length of material 206 to be fed to the corrugation head 200. Drive means and brake means, identical to that shown in FIGS. 8 and 9*a* with respect to the feed mechanism 230, are also provided, and are actuated in the same manner to intermittantly drive the reel 262. A guide tray 261 is provided to direct the sheet 206 to the head 200 from the reel 262. As seen in FIGS. 7 and 11*a*, this tray 261 is arranged to place the leading edge of the sheet 206 in a position so that the inward movement of a sealing device 280 clamps the material against the head 200. Feed rollers 240A, with a stepping drive motor 242A, and cutting means 244A, are also provided on the feed mechanism 260. In the same manner as described above for the components 240, 242, and 244 of the feed mechanism 230, the components 240A and 242A of the feed mechanism 260 function to feed a selected length of material 206 into a position between the head 200 and the sealing device 280. Then, the cutter 244A severs a selected length of material 206 from the reel 262, to continue the package-making operation.

The movable sealing device 280 incorporated in each of the units A–H is shown in FIGS. 7, 9, 11 and 12. As discussed above, the sheets 204, 206 and disc 208 are preferably heat-seal coated. Hence, the sealing device 280 is preferably a heat sealer which can heat the inner and outer sheets 204, 206, and the bottom disc 208, and seal the parts together during the operation of the machine 100. This heat sealer 280 is preferably positioned on the unit diametrically opposed from the corrugation roller 220, as seen in FIG. 7. The heater 280 is formed from several elements. A heat shoe 282 is positioned to frictionally engage with the outer sheet 206 as shown in FIGS. 12 and 12*a*, to clamp the material against the head 200. The shoe 282 heats the heat-seal coating on the engaged sheets 204 and 206, as described above, to form a two-ply corrugated side wall 202 for the package P. The shoe 282 preferably is provided with an anit-friction surface such as a surface made from a tetra fluoraethylene resin.

The sealing device 280 also carries a folding angle member 284, which can be positioned next to the face 214 of the corrugation head 200. As seen in FIGS. 12*a*, 13 and 14, this member 284 functions to fold a projecting portion of the outer sheet 206 over the edge of the bottom disc 208 during the rotation of the head 200. The final folding and sealing of the projecting portion of the outer sheet 206 against the disc 208 is accomplished by a rotating heating element 286. As shown in FIG. 12*b*, the rotating heating element 286 is dimensioned to project inwardly toward the head 200, beyond the position of the heat shoe 282. FIGS. 2 and 9 show that the element 286 is driven intermittantly by suitable belts and shafts connected to the final drive gear box 116. As described above, the gear box 116 is, in turn, driven by the indexer 114.

The operating temperatures for the shoe 282, the member 284 and the rotating element 286 vary with conditions such as the size and type of material and coating, the speed of the machine, the size of the components, etc. It has been found that, with the preferred type of paper described above, a high-speed operation can be maintained, and a sealing temperature between 230° F. and 280° F. applied to the inner and outer sheets 204, 206 and the bottom disc 208, if the elements 282, 284, 286 of the heat sealer 280 are heated to 550°-600° F.

An actuating device 290 is adapted to selectively drive the sealing device 280 inwardly toward the head 200. As shown in FIGS. 7 and 14, this actuating device 290 includes a pair of pneumatic hydraulic cylinders 290A and 290B, which are controlled, by the valves 'V' or other suitable means, to locate the sealing device 280 in one of two operating positions, or in a retracted non-operating position. In one operating position, the cylinders 290A and 290B move the device 280 inwardly a full stroke, so that the sealing device 280 is engaged with the outer sheet 206 and the disc 208 in the manner illustrated in FIGS. 12*a*, 13 and 13*a*. As explained above, in this fully inward position, the sealing device 280 functions to simultaneously seal the outer sheet 206 to the corrugated inner sheet 204 and also to seal the outer sheet 206 to the bottom wall disc 208. The second actuating position for the cylinders 290A and 290B and the device 280 is for the formation of the tear tab 210, as shown in FIG. 3. To produce the tear tab 210, the cylinder 290B is actuated to withdraw the device 280 a measured distance from the inward position, in the direction shown by the arrow in FIG. 14, to a second position as illustrated in FIGS. 14 and 14*a*. In this second position, the shoe 282 is out of contact with the outer sheet 206, and does not seal the sheet 206 to the corrugated inner sheet 204. However, the angle member 284 and the rotating sealing device 286 continue to engage with and fold the projecting portion of the outer sheet 206, and to seal that portion against the outer edge of the bottom disc 208. The activating means 290 is also operative to completely retract the sealing device 280 from engagement with the sheets 204, 206 and the disc 208, and the head 200.

As shown, for example, in FIGS. 12, 12*a*, and 13, a bottom wall disc 208 is placed against the front face 214 of the head 200 before the outer sheet 206 is wrapped around the inner sheet 204. This disc placement timing is necessary in the illustrated embodiment so that the above-described operation of the folding angle member 284 can fold the projecting portion of the outer sheet 206 over the edge of the disc 208.

FIGS. 9-12 illustrate the disc supply and transport mechanism 300 for supplying the bottom wall disc 208 to the head 200 at selected intervals. Referring to FIGS. 9 and 10 more specifically, the mechanism 300 for each unit A-H, includes a stack of discs 208 arranged in a tray 302. This tray 302 is inclined a few degrees toward the head 200, so that gravity assists in the feeding of the discs 208. A weighted roller 304 is provided to keep the discs 208 stacked in the tray 302, and to urge the discs toward the head 200. Detent means, such as washers 306, retain the supply of discs 208 in the tray 302.

When a disc 208 is to be moved to the front face 214 of the head 200, suitable control means activates a cylinder 308 or the like, which is connected to a pivoted suction arm 310 associated with the tray 302. As seen in FIG. 10, this suction arm 310 includes suction cups 310A which are connected to a vacuum source, and which swing into engagement with the adjacent bottom disc 208. Then, the reversed activation of the hydraulic cylinder 308 swings the suction arm 310 inwardly toward the corrugation head 200. The suction provided by the vacuum source and the cups 310A causes the arm 310 to carry the adjacent bottom disc 208 past the detents 306.

A receiving chute 312 is located below the storage tray 302, and has a groove 314 through which the traveling suction arm 310 travels. As seen in FIG. 10, the groove 314 strips the disc 208 from the arm 310, and places the disc 208 in the chute 312. Gravity causes the disc 208 to roll down the chute 312 until its motion is stopped by a retractable detent pin 316, connected to an activating solenoid 316A.

When a disc 208 is to be fed to the head 200, the solenoid 316A is activated to retract the pin 316. Gravity causes the disc 208 to roll downwardly onto a transport carriage 320. A second retractable pin 318, having an activating solenoid 318A, retains the disc 208 on the chute 312 until it is moved by the carriage 320. The carriage 320 includes a pair of support pins 322, such as shown in FIGS. 12 and 12*a*, to support the disc 208 in a self-centering arrangement.

As shown in FIGS. 10, 11 and 15, a pivoted arm 324 drives the disc 208 into engagement with the front face 214 of the head 200. A projecting center pin 323 is also provided on the head 200, to assist in the centering of the disc 208. A pneumatic or hydraulic cylinder 326 is actuated by a control system to swing the transport carriage 320 inwardly, to position the disc 208 against the front face 214 of the head 200, with the outer edge of the disc 208 aligned with the fluted corrugations on the periphery 211 of the head 200. As seen in FIG. 16, a dashpot 328, or other suitable dampening device, can be used to control the movement of the carriage 320. After the head 200 is engaged by the disc 208, the hydraulic cylinder 326 may be deenergized, and the carriage 320 positioned as illustrated in FIG. 12B. In this position, the pins 322 and 323 are positioned to center and support the disc 208, if necessary. A low friction surface 323A on the carriage 320 allows the disc 208 to rotate with the head 200 with respect to the carriage 320. As described above, the suction force transmitted by the vacuum ports 216 secures the disc 208 for rotation with the head 200.

Each unit A-H also includes a clamping device 330 for removing the completed package P from the corrugation head 200. As shown in FIGS. 11, and 15-17, this device 330 includes a pair of retractable clamps 332 provided with friction surfaces 334 shaped to coincide with the shape of the side wall 202 of the package P. The clamps 332 are activated by means, such as a pneumatic or hydraulic cylinder 336, into engagment with the outer sheet 206 of the package side wall 202, after the package-making operation is completed. To assist the engagement of the package by the clamps 332, the clamps can be provided with ports 338, as shown in FIG. 15a. A vacuum source is connected to each clamp, and applies a vacuum force to the completed package P through the ports 338, to draw the package away from the corrugation head 200 and into contact with the clamps 332. The removal of the package P also can be aided by simultaneously applying positive pressure through the ports 218 in the head 200, to force the package outwardly away from the head and against the clamps 332. The switch between positive air pressure and vacuum pressure is accomplished by a suitable valve 'V', as shown schematically in FIG. 12*a*.

As shown in FIGS. 15 and 16, when the clamps 332 are engaged with the package P, a rack and pinion device, including a drive cylinder 341, or other suitable means, can be activated to remove the package P axially from the head 200. In this action the clamps 332 and the package P are moved between an inward position as shown in FIG. 15 to an outward discharge position, as shown in FIGS. 16 and 16*a*. After the axial movement of the clamps 332 is sufficient to clear the package P from the head 200, the suction force in ports 338 is reversed to positive pressure, and the clamps 332 are opened. The package P is thereby ejected onto a conveyor 102A or other suitable receiving device. To assist in directing the completed package P in a selected path, such as illustrated in FIG. 17, the ports 338 can be angled outwardly from the clamps 332 at an angle of approximately 25° from the vertical, as shown in FIG. 16*a*. The clamping device 330 then can be returned to a retracted position, as shown in FIG. 11 and in phantom lines in FIG. 16*a*, in preparation for an additional cycle of operation of the A–H unit of the machine 100. As seen in FIGS. 11 and 12, the disc transport carriage 320 can conveniently be connected for movement with this clamping device 330.

As described above, a preferred arrangement for the machine 100 is for the indexer 114 for each unit A–H to produce an intermittant output drive which causes two complete revolutions of the associated corrugation head 200 for each revolution for the input shafts 110 or 112. The indexers 114 function through a clutch or other suitable intermittant drive to rotate the heads 200 during the operation of the machine 100. In the preferred embodiment illustrated in the drawings, a cycle of operation for the heads 200 is 180 degrees of rotation, and the indexers 114 are arranged to drive the heads 200 through four equally spaced 180 degree cycles for the completion of each package. Moreover, the indexers 114 provide an equal dwell time between cycles, so that other operations of the machine, which must precede a particular rotation cycle for the heads 200, can be performed. A suitable arrangement for this intermittant drive of the indexers 114 to complete one package P, is set forth in the following Table I:

TABLE I

| Indexer Input Shaft 110 or 112 Drive | Indexer Output And Rotation of Head 200 |
|---|---|
| 0°-90° | Off-no rotation |
| 90°-180° | On-rotate head 180° |
| 180°-270° | Off-no rotation |
| 270°-360° | On-rotate head 180° |
| 360°-450° | Off-no rotation |
| 450°-540° | On-rotate head 180° |
| 540°-630° | Off-no rotation |
| 630°-720° | On-rotate head 180° |

The machine 100 is further provided with a control system for actuating the functions of the various components of the machine as described above, in the proper sequence and for the proper duration. In the illustrated embodiment this control system includes an absolute encoder 104 connected to the main drive motor 104 and to an electronic digital controller 107 having memory capability. A suitable encoder 105 is an absolute optical encoder sold under the name "Decitrak", by Theta Instruments, Inc., of Fairfield, N.J. The encoder 105 is coupled to the motor 104 and, as known by those skilled in the art, creates an electrical output signal which electronically reads or indicates the exact rotational position of the output shaft of the motor 104. In the preferred arrangement, the encoder 105 creates a binary coded decimal output which is fed into the digital controller 107. As also known by those skilled in the art, the controller 107 has a programmed response to the encoder input, and thus creates output signals which operate control circuits for the various functions of the machine in relation to the absolute rotational position of the shaft for the motor 104.

It will be appreciated that programs for the controller 107 can be varied to suit the needs of a particular installation, such as for an increased or decreased production speed, or to adapt to modifications of the machine 100. Table II below lists a suitable program for the illustrated embodiment of the machine 100. This program shows the control over sixteen functions of the machine by the controller 107, in response to the coded signals of the encoder 105. In this program, the zero point for the shaft of motor 104 is assumed to be vertical 12 o'clock position.

TABLE II

| Controller Output | Function Controlled | Degree Position of Drive Shaft On | Off |
|---|---|---|---|
| 1 | Start/stop individual machine units A-H | 330 | 360 |
| 2 | Time indexers 114A-H | 350 | 360 |
| 3 | Feed inner sheet 204 | 180 | 190 |
| 4 | Feed outer sheet 206 | 265 | 275 |
| 5 | Cut inner sheet 204 | 12 | 22 |
| 6 | Cut outer sheet 206 | 102 | 112 |
| 7 | Corrugating roller 220 in | 15 | 180 |
| 8 | Head 200 discharge air off and vacuum on | 25 | 340 |
| 9 | Sealer 280 in | 100 | 270 |
| 10 | Tab sealing roller 286 in, shoe 282 out | 270 | 340 |
| 11 | Tab print (optional) | 115 | 180 |
| 12 | Clamp 330 closed; clamp vacuum on | 355 | 10 |
| 13 | Clamp 330 open and package eject | 355 | 45 |
| 14 | Pull disc 208 from tray 302 | 100 | 200 |
| 15 | Vacuum to disc pull arm 310 | 125 | 225 |
| 16 | Discharge air to clamp 330 | 15 | 35 |

The above program has been found to allow the production of about 10 packages P per minute for each unit A–H, or a total of about 80 packages per minute for the machine 100. Of course, refinements in the program and modifications in the components can be accomplished to produce a slower or faster rate of production.

The operation of the machine 100 will be explained with respect to the operation of one of the units A–H. It will be appreciated that in the illustrated machine, all of the units A–H are operated simultaneously, to substantially increase the output of the machine 100. The tandem arrangement of the units A–H in the machine 100 permits the load on the drive parts such as the motor 104, the shafts 110 and 112, etc. to be minimized by staggering the cycles of operation of the various units A–H. The demands on other energy sources for running the machine, such as the electrical supply, and the positive air pressure and vacuum supply, also can be minimized by this staggered operation of the units A–H. For example, the program for the controller 107 for the various units A–H can be selected so that alternate units are out of phase a selected degree of rotation of the motor 104. As seen in FIG. 1, the left-hand units A and E can be operated simultaneously, out of phase with units C and G. Similarly, on the right-hand side of the machine, units B and F can be operated in phase with units A and E, and units D and H can be operated in phase with the alternate units C and G.

The operation of each unit A–H is begun by energizing the unit A–H, and timing the indexers 114 to the beginning of the operating cycle. Then, the inner sheet feed mechanism 230 is activated to feed the inner sheet material 204 so that the lead edge is adjacent to the head 200 (see FIG. 7). The hydraulic cylinder 222 is activated to move the corrugating roller 220 inwardly, and to clamp the leading edge of the sheet 204 against the head 200. Then, the knife 244 is activated to sever the sheet 204 at a selected length from the sheet supply 232. This foregoing feeding, clamping and cutting activity is occuring in this first dwell phase for the rotatable corrugaton head 200. Then, the knife 244 is activated to sever a selected length of the sheet 204 from the sheet supply 232. This foregoing feeding, clamping and cutting activity is occuring in the first dwell phase for the rotatable corrugation head 200.

Next, the head 200 is rotated through a 180° cycle, with the vacuum source for the head energized. The vacuum operates through the ports 218 on the head to secure the sheet 204 to the head as it is rotated. The fluted periphery of the head 200 and the roller 200 corrugate a portion of the inner sheet 204 during this 180° rotation of the head.

As shown in Table II, simultaneously with the rotation of the head 200 through this first 180° cycle, the bottom disc transport mechanism 320 is being loaded, as described above with respect to FIG. 10, and is activated so that the arm 324 swings a bottom wall disc 208 into engagement with the front face 214 of the head 200. Thus disc 208 is in place against the head 200 before the completion of the feeding of the outer sheet 206. This outer sheet 206 is fed during the next dwell cycle for the head 200 by energizing the feeding mechanism 260. This feeding mechanism 260, as seen in FIGS. 7, 9 and 11*a*, positions the leading edge of the sheet 206 between the head 200 and the heat sealer 280. The activating means 290 is energized to clamp this leading edge of the sheet 206, between the heater 280 and the head 200. Then, the cutter 244*a* is energized to sever the sheet 206 at a selected length.

The operation of the unit through the next 180° cycle of rotation of the head 200 functions to corrugate the remaining portion of the inner sheet 204 between the head and the corrugating roller 220. Simultaneously, this second 180° rotation of the head 200 causes the heat sealer 280 to fold a portion of the outer sheet 206 against the bottom wall disc 208, and to simultaneously heat seal the outer sheet 206 to both the disc 208 and the corrugated portion of the inner sheet 204. A third cycle of rotation through a 180° arc for the head 200 occurs with the heat sealer 280 continuing in an inward position. This third cycle completes the sealing of the outer sheet 206 to the bottom wall 208 and the corrugated inner wall 204. As shown in FIG. 5, this sealing of the outer sheet 206 to the inner sheet 204 is performed so that the ends of the corrugated sheet 204 abut but do not overlap.

In a preferred form of the package P, the package is provided with a pull tab 210, as described above. To complete this pull tab, the activating cylinder 290 is energized to retract the heater 280 into a second position, with the heat shoe 282 out of engagement with the outer sheet 206, but with the heating wheel 286 continuing in engagement with the sheet 206 adjacent the bottom wall 208 (see FIGS. 14, 14*a*). With the heat sealer 280 in this position, the rotation of the head 200 thru a fourth cycle of 180° produces the pull tab 210 by sealing the trailing end of the sheet 206 only to the bottom wall member 208. The head 200 continues to rotate after this pull tab is completed, to return to a starting position, so that the cycle for making a second package can begin.

After the package has been completed in the above-described manner, the package clamping device 330 is activated, along with the clamp vacuum, so that the clamps 332 engage with the side walls of the package P. At the same time, the control device 107 can be programmed to reverse the vacuum force in the head 200, and to apply positive pressure to the package through the head. In this manner, the frictional engagement between package P and the clamps 332 is assured.

With the clamps in a closed position, the package is ejected from the head 200 by energizing the rack and pinion 340 and the drive cylinder 341, to move the package P and the clamps 332 from an inward position, as shown in FIG. 15, to an outward discharged position, as shown in FIG. 16. With the package in the discharged position, the clamps 332 are opened, and the clamp vacuum force is reversed to create a positive air pressure force which flips the package P out of the clamps 332 and onto a suitable conveyor 102A or 102B, as shown in FIG. 17.

The method of forming a corrugated package in accordance with this invention, is apparent from the above description. The method generally comprises the steps of corrugating an inner sheet of material of a selected width to define a portion of a side wall of a package; positioning a bottom wall member having an outer edge adjacent to the inner sheet in its corrugated position; wrapping an outer sheet of material having a greater width around the inner sheet, to project over the outer edge of the bottom wall member, and then simultaneously joining the outer sheet to the first sheet and to the bottom wall, so that a multi-ply side wall of corrugated material is produced simultaneously with the production of the completed package. In the preferred method, as set forth above, the sheet material and the bottom wall member are provided with heat seal coatings, and the step of joining the sheet of the bottom wall together comprises providing heat which joins the engaged surfaces of the sheets and the bottom wall. It is further preferred that the wrapping of the outer sheet is continued beyond the inner sheet, to provide a pull tab for the side wall from the trailing end of the outer sheet. The ends of the inner corrugated sheet are abutted adjacent the pull tab, but do not overlap, to facilitate removal of the side wall from the bottom wall by a force applied to the pull tab.

Preferably, the method is performed as the head 200 is intermittantly driven through 180° cycles, as described above. The method further includes the steps of disengaging the completed package from the head by clamping the package and removing it from the head. Vacuum and air forces are selectively applied during the steps of the method to assist in securing the sheets to the corrugating head 200, and in assisting in the clamping and discharging of the completed package from the head.

Although the invention has been described above with a certain degree of particularity with respect to the apparatus and method for making a corrugated package, it should be understood that this disclosure has been made only by way of example. Consequently, numerous changes in the details of construction and in the combination and arrangement of the components, as well as in the possible modes of utilization and methods of operation, will be apparent to those familiar with the art and may be resorted to without departing from the scope of this invention as claimed.

What is claimed is:

1. A machine for forming a corrugated package having sufficient rigidity to protect during formation or storage within the package and having a readily openable sidewall which facilitates display and use of the product, said machine comprising:

a rotatable corrugation head having a front face and a rigid fluted periphery of a selected circumference;

corrugating means movable into association with said head for gripping a sheet of material and urging said sheet into conformance with said fluted periphery;

vacuum means to secure said sheet to said head in conformance with said fluted periphery;

activating means to selectively move said corrugating means between a disengaged position removed from said head and a position associated with said head;

means for feeding a first pre-cut sheet of material having a selected length and width between said head and corrugating means for forming the inner corrugated sheet of the package sidewall by rotation of said head with said inner sheet secured thereto, the length of said first sheet being coordinated with respect to the periphery of said corrugation head so that the free ends of said sheet are adjacent when said sheet is secured around said head;

means for locating a bottom wall member having a selected shape and an outer edge adjacent said front face of said head with said edge aligned with said fluted periphery;

means for securing said bottom wall member to said front face for rotation with said head;

means for feeding a second precut sheet of material to said head for forming the outer sheet of the package sidewall, said outer sheet having a selected length sufficient to surround said corrugated inner sheet secured to said head and a selected width greater than the width of said inner sheet;

sealing means movable into association with said head for joining said inner corrugated sheet only to said outer sheet as said head is rotated so that said adjacent free ends of said inner sheet form an unsealed joint across said sidewall, said sealing means also sealing said outer sheet to said bottom wall member as said head is rotated so a frangible joint is formed between said bottom wall member and said sidewall, said sealing means thereby completing the formation of the package by providing a rigid corrugated sidewall which can be readily removed from said bottom wall to open said package; and sealer activating means for moving said sealing means between a disengaged portion removed from said head and an operating position in association with said head.

2. A machine in accordance with claim 1 including a source of supply of said inner and outer sheet material and wherein said feeding means includes means to measure a selected length of said inner sheet and position a free end thereof for engagement between said head and corrugating means; means to cut said inner sheet to said selected length before securing said inner sheet to said head; means to measure a selected length of said outer sheet and position a free end thereof for engagement between said head and sealing means; and means to cut said outer sheet to said selected length before sealing said outer sheet to said inner sheet; said machine thereby forming said corrugated sidewall from pre-cut sheets which are substantially isolated from the inertial drag forces of said feeding means and said supply.

3. A machine in accordance with claim 2 wherein each of said sheet feeding means further includes a reel of sheet material comprising a material supply source; feed rollers for accurately measuring and feeding said selected length of the associated material from said reel toward said head; means to drive said reel; and slack take-up means positioned between said feed rollers and reel and adapted to provide a loop of material of approximately said selected length to thereby isolate said feed rollers from the load of said reel.

4. A machine for forming a package in accordance with claim 1 wherein said vacuum means to secure a sheet of material to said corrugation head comprises a plurality of port means provided in said fluted periphery and connected to a source of partial vacuum prssure.

5. A machine in accordance with claim 4 wherein said means for securing said bottom wall member to said face of said head comprises port means provided on said face connected to a source of a partial vacuum pressure and adapted to secure said wall member by the applicaton of a vacuum force thereto.

6. A machine in accordance with claim 1 wherein the engagable portions of said inner and outer sheet material and said bottom wall member are provided with a heat seal coating and further wherein said sealing means comprises a heating means movable into position to heat seal said inner sheet only to outer sheet and said outer sheet to said bottom wall member as said corrugation head is rotated.

7. A machine in accordance with claim 6 wherein said heating means includes a heated element engagable with said outer sheet material to fold and heat seal said outer sheet material into engagement with said bottom wall member as said corrugation head rotates.

8. A machine for forming a corrugated package comprising:

a rotatable corrugation head having a front face and a fluted periphery provided with means to secure a sheet of material thereto;

corrugating means movable into association with said head for corrugating a sheet of material therebetween;

actuating means to selectively move said corrugating means between a disengaged position removed from said head and a position associated with said head;

means for feeding an inner sheet of material having a selected length and width between said head and corrugating means for forming the inner corrugated sheet of the sidewall of said package by rotation of said head with said inner sheet secured thereto;

movable transport means for transporting a bottom wall member having a selected shape and an outer edge into engagement with said front face of said head with said edge aligned with said fluted periphery;

means for securing said bottom wall member to said front face for rotation with said head;

transport actuating means for moving said transport means between a disengaged position removed from said head and an operating position engaging said bottom wall member with said head;

heating means movable into association with said corrugating head for heat-sealing an outer sheet of material having a width greater than the width of said inner sheet to said corrugated inner sheet and to said bottom wall member as said inner sheet and member are rotated with the rotation of said corrugating head, the engagable portions of said inner and outer sheet material and said bottom wall member being heat-sealable in response to said heating means;

means for feeding a selected length of said outer sheet of material between said sealing means and said head for forming the outer sheet of the package side wall and joining said side wall to said bottom wall upon rotation of said head to form a completed package; and sealer actuating means adapted to move said heating means selectively into a first operating position to seal said outer sheet to said inner sheet and said bottom wall member and a second operating position to seal said outer sheet to said bottom wall member.

9. A machine for forming a corrugated package comprising:

a rotatable corrugation head having a front face and a fluted periphery provided with means to secure a sheet of material thereto;

corrugating means movable into association with said head for corrugating a sheet of material therebetween;

actuating means to selectively move said corrugating means between a disengaged position removed from said head and a position associated with said head;

means for feeding an inner sheet of material having a selected length and width between said head and corrugating means for forming the inner corrugated sheet of the sidewall of said package by rotation of said head with said inner sheet secured thereto;

movable transport means for transporting a bottom wall member having a selected shape and an outer edge into engagement with said front face of said head with said edge aligned with said fluted periphery;

means for securing said bottom wall member to said front face for rotation with said head;

transport actuating means for moving said transport means between a disengaged position removed from said head and an operating position engaging said bottom wall member with said head;

sealing means movable into association with said corrugating head for joining an outer sheet of material having a width greater than the width of said inner sheet to said corrugated inner sheet and to said bottom wall member as said inner sheet and member are rotated with the rotation of said corrugating head;

sealer actuating means for moving said sealing means between a disengaged position removed from said head into an operating position in association with said head;

means for feeding a selected length of said outer sheet of material between said sealing means and said head for forming the outer sheet of the package side wall and joining said side wall to said bottom wall upon rotation of said head to form a completed package; and means to remove said completed package from said head including clamping means which selectively clamps the package and moves to discharge the completed package generally axially from said head.

10. A machine in accordance with claim 9 wherein said clamping means further includes port means adapted to conduct a partial vacuum pressure to draw said completed package from said head toward said clamping means and pressure control means to selectively release said vacuum pressure.

11. A machine in accordance with claim 10 wherein said pressure control means is selectively reversible to apply positive pressure in said port means to assist in displacing the complete package from said clamping means.

12. A machine in accordance with claim 11 wherein said port means are angled in said clamping means away from said corrugation head so that the application of said positive pressure through said port means directs said completed package away from said corrugation head.

13. A machine for forming a corrugated package comprising:

a rotatable corrugation head having a front face and a fluted periphery provided with means to secure a sheet of material thereto;

corrugating means movable into association with said head for corrugating a sheet of material therebetween;

actuating means to selectively move said corrugating means between a disengaged position removed from said head and a position associated with said head;

means for feeding an inner sheet of material having a selected length and width between said head and corrugating means for forming the inner corrugated sheet of the sidewall of said package by rotation of said head with said inner sheet secured thereto;

means for cutting said inner sheet to a selected length;

movable transport means for transporting a bottom wall member having a selected shape and an outer edge into engagement with said front face of said head with said edge aligned with said fluted periphery;

means for securing said bottom wall member to said front face for rotation with said head;

transport actuating means for moving said transport means between a disengaged position removed from said head and an operating position engaging said bottom wall member with said head;

heat sealing means movable into association with said corrugating head for heat sealing an outer sheet of material having a width greater than the width of said inner sheet to said corrugated inner sheet and to said bottom wall member as said inner sheet and member are rotated with the rotation of said corrugating head, the engagable portions of said inner and outer sheet material and said bottom wall member being heat sealable in response to said heating means;

sealer actuating means for moving said sealing means between a disengaged position removed from said head into an operating position in association with said head;

means for feeding a selected length of said outer sheet of material between said sealing means and said head for forming the outer sheet of the package side wall and joining said side wall to said bottom wall upon rotation of said head to form a completed package;

means for cutting said outer sheet to a selected length; and control means for sequentially feeding said inner sheet into engagement with said head; moving said corrugating means toward said head to clamp said inner sheet therebetween; moving said cutting means to cut said inner sheet to a selected length; rotating said head for a first cycle to corrugate a portion of said inner sheet; moving said transport means to secure a bottom wall member to said head; feeding an outer sheet into engagement with said inner sheet adjacent said sealing means; clamping said inner and outer sheets together by moving said sealing means into association with said head; moving said cutting means to cut said outer sheet to a selected length; rotating said head through a second cycle to seal said outer sheet to said bottom wall and said corrugated portion of said inner sheet while corrugating the remainder of said inner sheet; and rotating said head through a third cycle to seal said outer sheet to the bottom wall member and to the remainder of said inner sheet.

14. A machine for forming a corrugated package having sufficient rigidity to protect a product during formation or storage within the package and having a readily openable sidewall which facilitates display and use of the product, said machine comprising:

a rotatable corrugation head having a front face and a rigid fluted periphery of a selected circumference;

corrugating means movable into association with said head for gripping a sheet of material and urging said sheet into conformance with said fluted periphery;

vacuum means to secure said sheet to said head in conformance with said fluted periphery;

activating means to selectively move said corrugating means between a disengaged position removed from said head and a position associated with said head;

means for cutting a first sheet of material having a selected length to a selected length;

means for feeding said first precut sheet of material between said head and corrugating means for forming the inner corrugated sheet of the package sidewall by rotation of said head with said inner sheet secured thereto, the length of said first sheet being coordinated with respect to the periphery of said corrugation head so that the free ends of said sheet are adjacent when said sheet is secured around said head;

means for locating a bottom wall member having a selected shape and an outer edge adjacent said front face of said head with said edge aligned with said fluted periphery;

means for securing said bottom wall member to said front face for rotation with said head;

means for cutting a second sheet of material having a selected width to a selected length;

means for feeding said second precut sheet of material to said head for forming the outer sheet of the package sidewall, the length of said outer sheet being selected to be sufficient to surround said corrugated inner sheet secured to said head and said width being selected to be greater than the width of said inner sheet;

sealing means movable into association with said head for joining said inner corrugated sheet only to said outer sheet as said head is rotated so that said adjacent free ends of said inner sheet form an unsealed joint across said sidewall, said sealing means also sealing said outer sheet to said bottom wall member as said head is rotated so that a frangible joint is formed between said bottom wall member and said sidewall, said sealing means thereby completing the formation of the package by providing a rigid corrugated sidewall which can be readily removed from said bottom wall to open said package;

sealer activating means for moving said sealing means between a disengaged portion removed from said head and an operating position in association with said head; and control means for sequentially feeding said inner sheet into engagement with said head; moving said corrugating means toward said head to clamp said inner sheet therebetween; moving said cutting means to cut said inner sheet to a selected length; rotating said head for a first cycle to corrugate a portion of said inner sheet; moving bottom wall member into said position adjacent said head; feeding an outer sheet into engagement with said inner sheet adjacent said sealing means; clamping said inner and outer sheets together by moving said sealing means into association with said head; moving said cutting means to cut said outer sheet to a selected length; rotating said head through a second cycle to seal said outer sheet to said bottom wall and said corrugated portion of said inner sheet while corrugating the remainder of said inner sheet; and rotating said head through a third cycle to seal said outer sheet to the bottom wall member and to the remainder of said inner sheet.

15. A machine in accordance with claim 13 or 14 wherein said length of said outer sheet is selected to extend beyond the peripheral length of said corrugated inner sheet to form a pull tab and said control means rotates said head through a fourth cycle, with said sealing means partially withdrawn from said head, to secure said pull tab to said bottom wall member.

* * * * *